US006341889B1

(12) United States Patent
Noda et al.

(10) Patent No.: US 6,341,889 B1
(45) Date of Patent: Jan. 29, 2002

(54) METHOD FOR DISTRIBUTING LIQUID BY CONTROLLING ROTATION SPEED OF A SHAFT AS A FUNCTION OF THE LIQUID DEPTH IN A TANK

(75) Inventors: Hideo Noda, Amagasaki; Takaya Inoue, Takatsuki; Hiroshi Yamaji, Sanda, all of (JP)

(73) Assignee: Kansai Chemical Eng. Col. Ltd., Amagasaki (JP)

( * ) Notice: Subject to any disclaimer, the term of this patent is extended or adjusted under 35 U.S.C. 154(b) by 0 days.

(21) Appl. No.: 09/506,744

(22) Filed: Feb. 18, 2000

(30) Foreign Application Priority Data

Feb. 22, 1999 (JP) ..... 11-042762

(51) Int. Cl.[7] ..... B01F 5/10; B01F 7/16

(52) U.S. Cl. ..... 366/262; 366/325.1; 366/326.1; 366/328.2; 366/601

(58) Field of Search ..... 366/262–265, 366/270, 279, 292, 325.1, 325.92, 325.93, 326.1, 328.1–330.1, 336–340, 342, 343, 349, 601; 416/231 A; 261/91, 93

(56) References Cited

U.S. PATENT DOCUMENTS

| | | | |
|---|---|---|---|
| 8,596 A | 12/1851 | Skinner | |
| 38,891 A | 6/1863 | Emerson | |

(List continued on next page.)

FOREIGN PATENT DOCUMENTS

| | | | |
|---|---|---|---|
| CH | 248204 | 4/1947 | |
| DE | C-185488 | 5/1907 | |
| DE | A-1658067 | 2/1970 | |
| DE | A-1658815 | 8/1970 | |
| DE | A-1941146 | 2/1971 | |
| DE | A-1963614 | 6/1971 | |
| DE | A-1964125 | 6/1971 | |
| DE | B-1609032 | 3/1972 | |
| DE | A-2418679 | 10/1975 | |
| DE | A-2923375 | 12/1979 | |
| DE | A-2844038 | 4/1980 | |
| EP | A-0000293 | 1/1979 | |
| EP | A-619136 A1 | 10/1994 | |
| EP | 0 916 390 A1 | 6/1998 | |
| FR | A-2009464 | 2/1970 | |
| FR | 2626787 | 8/1989 | |
| GB | 127705 | 6/1919 | |
| GB | 749327 | 5/1956 | |
| JP | 45-39590 | * 12/1970 | ..... 366/601 |
| JP | 54-27160 | 9/1979 | |
| JP | 60-83038 | 6/1985 | |
| JP | 5513702 | 10/1991 | |
| SU | 310669 | 12/1971 | |
| SU | 562303 | 6/1977 | |
| SU | 689713 | * 10/1979 | ..... 366/601 |
| SU | 914077 | 2/1980 | |
| SU | 997774 | 2/1983 | |
| SU | 1030002 | * 7/1983 | ..... 366/601 |
| SU | 1042786 | 9/1983 | |
| SU | 1151282 | 4/1985 | |
| SU | 1428714 | 10/1988 | |
| SU | 1542601 | 2/1990 | |

*Primary Examiner*—Charles E. Cooley
(74) *Attorney, Agent, or Firm*—Jagtiani & Associates

(57) ABSTRACT

With a liquid ejection apparatus where a liquid-transporting body is attached to an agitator shaft, the liquid-transporting body is revolved about the agitator shaft, with the rotational speed being changed in accordance with a change in liquid depth. Hence ejection liquid ejected from an upper opening of the liquid-transporting body over a large ejection distance and in sufficient volume, is distributed onto the inner surface of the tank and/or into the space above the liquid surface, thereby washing the inner surface of the tank, maintaining the heat transfer area, dispersing a foam layer on the liquid surface, and promoting evaporation of liquid in the tank.

14 Claims, 19 Drawing Sheets

U.S. PATENT DOCUMENTS

| | | | | | |
|---|---|---|---|---|---|
| 60,097 | A | | 11/1866 | Waller | |
| 469,058 | A | | 2/1892 | Currier | |
| 836,717 | A | | 11/1906 | Trent | |
| 873,131 | A | | 12/1907 | Leiser | |
| 979,510 | A | | 12/1910 | Keller | |
| 1,535,147 | A | | 4/1925 | Colpitts | |
| 2,106,529 | A | | 1/1938 | Keller | |
| 2,143,652 | A | | 1/1939 | Gaertner | |
| 2,800,315 | A | | 7/1957 | Griesbach | |
| 3,334,870 | A | | 8/1967 | Kropp et al. | |
| 3,704,009 | A | | 11/1972 | Kalbskopf | |
| 3,911,065 | A | | 10/1975 | Martin et al. | |
| 3,920,227 | A | * | 11/1975 | Davis, Jr. | |
| 3,944,119 | A | | 3/1976 | Egee | |
| 4,145,143 | A | | 3/1979 | Fontaine | |
| 4,310,437 | A | | 1/1982 | Schreiber | |
| 4,508,455 | A | | 4/1985 | Lerman et al. | |
| 4,668,096 | A | * | 5/1987 | Saaty | |
| 5,061,375 | A | | 10/1991 | Oyler | |
| 5,338,115 | A | | 8/1994 | Gregg | |
| 5,660,468 | A | * | 8/1997 | Okajima et al. | |
| 6,241,381 | B1 | * | 6/2001 | Noda et al. | 366/262 |

* cited by examiner

METHOD FOR DISTRIBUTING LIQUID BY CONTROLLING ROTATION SPEED OF A SHAFT AS A FUNCTION OF THE LIQUID DEPTH IN A TANK

BACKGROUND OF THE INVENTION

1. Field of the Invention

The present invention relates to a liquid ejection apparatus and a liquid ejection method using the liquid ejection apparatus. More particularly, the invention relates to a liquid ejection apparatus and a liquid ejection method for ejecting liquid inside a tank towards a peripheral wall of the tank and for distributing the liquid onto an inner peripheral surface of the tank peripheral wall and/or into a space above the liquid surface inside the tank.

2. Description of the Related Art

In fermentation and culturing, the fermenting liquids and culturing liquids are both very prone to foaming. Due to agitation during the process, there is a considerable amount of foaming so that operability is often impaired. In order to inhibit such foaming, and to disperse the temporarily created foam, defoaming agents such as silicone are added to both the fermenting liquids and culturing liquids. The addition of such defoaming agents however not only involves significant cost, but also poses a risk adversely affecting the fermentation and culturing processes, because these defoaming agents are in themselves foreign substances to the liquids. In addition, the defoaming agents are mixed with the product as impurities so that the quality of the product is degraded. Therefore the defoaming agent must be removed from the product and this removal of the defoaming agent takes time. Furthermore the defoaming agents added to both the fermenting liquids and culturing liquids are mixed in the waste liquid and thus impede the treatment of the waste liquid. Hence the addition of defoaming agents is an undesirable means, which should be avoided as much as possible.

Moreover, in order to disperse the foam, experiments have been made to collapse the foam with shearing forces using mechanical means involving turning a disk within the foam layer on the liquid surface, or turning a hollow cylindrical body of truncated cone shape with a lower opening of the large diameter facing the liquid surface inside the tank. However with such means, not only is a considerable amount of energy required, but also the foam is often only merely broken up finely, and is not ultimately dispersed.

Another problem is that the inner peripheral surface of the peripheral wall of the agitating tank used as both a fermenting tank and a culturing tank becomes contaminated by microorganisms or solid raw materials or products being deposited thereon. This often causes a decrease in reaction yield or a reduction in heat transfer coefficient of the agitating tank peripheral wall. In this case, it is practically impossible to wash the inner peripheral surface of the inner wall of the agitating tank in order to remove the extraneous matter from the inner peripheral surface of the agitating tank without stopping the operation in the agitating tank.

Yet another problem arises with agitating tanks which are used as crystallization tanks or the like, when apparatus such as jackets and coiled pipes, and multi-tube heating units are respectively provided on the outer peripheral surface of the peripheral wall of the agitating tank, and/or are immersed into the liquid inside the agitating tank, as apparatus for heating or cooling the liquid inside the agitating tank, so that the inner peripheral surface of the peripheral wall and/or the surface of the portion of the heating or cooling apparatus which is immersed into the liquid becomes a heat transmission surface. In this case there is often the situation where the volume of liquid inside the agitating tank decreases due for example to evaporation, so that with time, the liquid level inside the agitating tank drops, and hence the heat transfer area of the heating or cooling apparatus cannot be effectively utilized.

In order to increase and hence recover the reduced heat transfer area, there are a method wherein fresh liquid is supplied to the tank so that the liquid surface is raised; or a method wherein the remaining liquid inside the tank is circulated by means of a pump provided outside of the tank until the liquid is distributed onto the inner peripheral surface of the tank peripheral wall. The former wherein fresh liquid is supplied to the tank, has the defect that there is an abrupt change in the composition of the liquid inside the tank, requiring an abrupt change in operational conditions to counter this, and also the quality of the product changes. Moreover, the latter has the defect that it requires a pump and piping for circulating the remaining liquid, so that, after operation, residual liquid remains in the tank as well as inside the piping. Consequently, the former means cannot be practically employed. Moreover, the latter requires improvements in order to be practical. Accordingly, means which can be put into practice to solve the defect that the heat transfer area cannot be effectively used have yet to be found.

When desired, in order to evaporate the liquid inside the agitating tank, normally methods are adopted which involve immersing a heating device into the liquid, or mounting a heating device on the outer peripheral surface of the agitating tank. The liquid is heated thereby to cause evaporation from the liquid surface either while agitating or not agitating the liquid. The methods are sometimes effected under reduced pressure or under pressure. With these methods there is the defect that heat in the space above the surface of the liquid which is heated by the heating device only heats the surface of the liquid and hence cannot be effectively utilized, and that the heating of the liquid inside the tank is limited to the contact surface of the heating device and the liquid surface. Accordingly, the heat from the heating device cannot be effectively utilized. Hence, the rate of the evaporation of the liquid is slow.

The present inventors, by using only mechanical agitation, have effectively overcome all of the heretofore various defects such as; the uncertain defoaming using shearing forces, the contamination of the inner peripheral surface of the agitating tank, the reduction in heat transfer area at the inner peripheral surface of the agitating tank, the contamination and reduction of the heat transfer area of the heating or cooling apparatus provided inside the tank, and the delayed evaporation of the liquid inside the agitating tank. Moreover, the present inventors made a thorough study on apparatus and methods enabling with good efficiency and reliable defoaming, all of washing of the inner peripheral surface of the agitating tank, retention of the heat transfer area on the inner peripheral surface of the agitating tank, washing of the heat transfer surface of the heating or cooling apparatus, and promotion of evaporation of the liquid inside the agitating tanks.

SUMMARY OF THE INVENTION

It is an object of the present invention to take into consideration the above situation with conventional liquid ejection apparatus and provide an improved liquid ejection apparatus and improved liquid ejection method using the liquid ejection apparatus.

The present inventors, with these apparatus and methods, have found that, in order to distribute the liquid inside the tank over the widest possible area of the inner peripheral surface of the tank, the liquid as much as possible is ejected from the liquid-transporting body and is allowed to reach as high as possible on the inner peripheral surface of the tank. Therefore, if the inclination angle of the liquid-transporting body remains the same, the rotational speed of the agitating shaft on which the liquid-transporting body is mounted can be increased in accordance with the drop in the liquid level as the liquid depth becomes shallower. In this way, the construction can be simplified. The present invention has been achieved based on this new knowledge.

According to a first aspect of the invention there is provided a liquid ejection apparatus wherein a liquid-transporting body having a lower opening and an upper opening at respective lower and upper end portions thereof is mounted on an agitator shaft by means of an attachment device, and the liquid-transporting body is revolved about the agitator shaft with the lower opening of the liquid-transporting body immersed beneath a liquid surface in a tank, and the upper opening of the liquid-transporting body exposed from the liquid surface. The revolving speed is changed in accordance with a change in the liquid depth inside the tank. The liquid-transporting body raises the liquid in the immersed portion of the liquid-transporting body, and ejects the liquid from the upper opening of the liquid-transporting body until the liquid is distributed onto an inner peripheral surface of a tank and/or into a space above the liquid surface in the tank.

According to a second aspect of the invention there is provided a method of ejecting a liquid wherein the liquid-transporting body of the liquid ejection apparatus according to the first aspect of the invention is revolved about the agitator shaft with the lower opening immersed beneath the liquid surface and the upper opening exposed from the liquid surface, so that the liquid-transporting body raises the liquid at the immersed portion of the liquid-transporting body, and ejects the liquid from the upper opening of the liquid-transporting body, until the liquid is distributed onto the inner peripheral surface of the tank and/or into the space above the liquid surface in the tank.

With the present invention, unless otherwise defined, the terms upper and lower are respectively defined as a position far from the bottom of the liquid and a position near to the bottom of the liquid.

The attachment device is for mounting the liquid-transporting body on the agitator shaft. The attachment device may be a rod, a square bar, a shaped steel body, a plate formed with one or more openings (referred to hereunder as a punched plate), or a non-punched plate. With the non-punched plate and punched plate, preferably these are respectively attached horizontally to the agitator shaft so that when turned within a liquid, the fluid resistance does not become excessively large. The attachment device or a part thereof may be used as an agitator for the liquid when immersed in the liquid in the tank. Those plates are normally respectively positioned approximately on a radius or diameter in the revolution plane. Moreover, the horizontal punched plate and the horizontal non-punched plate are positioned with their center approximately coincided with the center of the revolution plane. The number of the plates may be one or more. When a plurality are used, then normally each member is positioned either on the same revolution plane or on revolution planes differing from each other. Normally only one liquid transporting body is attached to one attachment device on a radius between the agitator shaft and the circumferential edge. However, there is no objection to providing a plurality of liquid-transporting bodies on this radius.

With the liquid ejection apparatus of the present invention, the rotational speed of the agitating shaft is changed corresponding to the change in the liquid depth inside the tank. For example the rotational speed of the agitating shaft is increased as the liquid depth inside the tank becomes shallower so that the turning speed of the liquid-transporting body is increased. To achieve this, preferably the liquid depth inside the tank is detected, and the detected liquid depth is transmitted, for example, via a controller or a computer to a rotational speed change apparatus such as an electric motor installed in the prime mover for driving the agitating shaft, and the rotational speed of the prime mover is then adjusted to a rotational speed corresponding to the liquid depth. Here, the agitator shaft and the prime mover for driving the agitator shaft are directly connected, or a indirectly connected via a belt or a gear or the like.

Load of the prime movers such as electric motors and torque of the agitator shaft become smaller as liquid depth becomes shallower. Change of the load on the electric motor and the torque in the agitator shaft, corresponding to change of liquid depth, may be detected in place of detecting the liquid depth. That is to say, electric current values respectively are set beforehand corresponding to predetermined sizes of loads on the electric motor and torques of the agitator shaft (the set electric current values are referred to hereunder as the set current values). In the case where the respective sizes of the load on the electric motor and the torque of the agitator shaft are reduced with a drop in liquid level until the electric current supplied to the electric motor drops, the supply current to the electric motor to compensate for a difference between the set current value and the dropped current value is increased, thereby increasing the rotational speed of the electric motor. When the current supplied to the electric motor attains the set current value, then the electric motor is restored to the rotational speed corresponding to the set current value. In this case however, an upper limit for the rotational speed of the electric motor should be set beforehand so that this does not increase to a rotational speed which exceeds the capacity of the liquid ejection apparatus. In order to change the rotational speed of the electric motor corresponding to the change of liquid depth, a known means for this can be applied.

As a detector of liquid depth inside the tank, normally liquid level indicators can be suitably used. The liquid level indicator detects the change in the height of the liquid level inside the tank. There is no particular limitation to the type of instrument or apparatus, provided this is able to transmit the detected liquid depth. As a suitable representative example, there is a differential pressure transducer such as a differential pilot, or a float transmitter such as a float pilot. For the liquid depth detector, a commercial product may be used. Moreover, it is also possible to detect the liquid depth inside the tank by eyes, and to non-automatically adjust the rotational speed of the electric motor for driving the agitator shaft, corresponding to the observation.

Normally for the detection of the torque of the agitator shaft and the load on the electric motor, a torque meter and a dynamometer are suitably used respectively. For the torque meter and the dynamometer, respective commercial products may be used.

As a representative example of a suitable rotational speed change apparatus, there is an electric motor incorporating an inverter (referred to hereunder as an inverter speed changer), a Beier Variator (trade name) speed changer, a RINGCONE (trade name) speed changer and the like. Especially the inverter speed changer is preferred. An inverter involves a system or apparatus for converting DC current into AC current. The inverter speed changer changes the primary frequency of an AC electric motor using an inverter, to thereby change the rotational speed of the electric motor. The inverter preferably has a motor stall prevention function. By means of the motor stall prevention function of the inverter, the change of the liquid depth, and the change of the respective sizes of the load on the electric motor and the torque in the agitator shaft can be detected, and the rotational speed of the electric motor is then controlled so that the respective sizes of the load on the electric motor and the torque in the agitator shaft become constant. Hence stall occurring during operation of the liquid ejection apparatus can be prevented. As the rotational speed change apparatus, a commercial product can be used.

By means of the rotational speed change apparatus, the respective sizes of the load on the electric motor and the torque in the agitator shaft can be automatically controlled to become constant. Therefore, for example in the case where the rotational speed change apparatus is a Beier Variator speed changer, an electric type automatic remote control unit is installed instead of a manual speed change handle. A signal from the dynamometer or the torque meter is sent to an adjuster of the electric type automatic remote control unit. When the electric current corresponding to the respective sizes of the load on the electric motor and the torque in the agitator shaft sent by this signal differs from a previously set current value, a signal for this difference is sent to a speed setter, and, corresponding to this signal, an electric signal is sent from the speed setter to the electric type automatic remote control unit, to sequentially turn or reverse turn the speed change handle. As a result, the rotational speed of the Beier Variator speed changer is increased or decreased, to thereby increase or decrease the rotational speed of the electric motor.

If the torque of the agitator shaft or the load on the electric motor sent by the signal from the torque meter or dynamometer in the adjuster of the electric type automatic remote control unit is not different from the previously set torque or load, then the rotational speed of the Beier Variator speed changer, that is to say the rotational speed of the electric motor does not change becoming a constant speed rotation. Moreover, for the controller, normally a digital controller is used, but an analogue controller may also be used.

Here, the controller is also referred to as a blind controller. This is a control device which has a function for automatically adjusting the control amount in the automatic control apparatus. It comprises a setting section and an adjusting section. It makes adjustment by generating a signal such that a difference between a value corresponding to a signal (control amount) supplied from outside, for example the size of the torque, and a value previously set in the setting section, is reduced by the joint use in the adjusting section of three of proportional action; differential action or integral action; or proportional action, differential action and integral action. For the controller, a commercial product can be used. Moreover, the controller can be connected to an inverter. In this case if there is no stall prevention function of the inverter, the frequency can be changed by the signal from the controller, and hence this is preferable.

As the liquid-transporting body, it is sufficient if liquid can pass therethrough. Normally, this is a tubular body, a plate body, a gutter body (the tubular body, the plate body and the gutter body are generically referred to hereunder as slim type liquid-transporting bodies), a bottomless open circular tube (referred to hereunder as a tube type liquid-transporting body) with a longitudinal axis thereof coincided with the agitator shaft, and a bottomless inverted truncated cone open tube body (referred to hereunder as an inverted truncated cone type liquid-transporting body) (both the tube type liquid-transporting body and the inverted truncated cone type liquid-transporting body are generically referred to hereunder as stout type liquid-transporting bodies). With the inverted truncated cone type liquid-transporting body, the wall may be curved at a small curvature towards the inside. Preferred liquid-transporting body is an open pipe gutter having the same shape as a trough along the edge of the eaves of a building to carry off rainwater.

For the slim type liquid-transporting body, for example the devices as illustrated in JP 6-335627A may be used.

The liquid-transporting bodies are respectively provided with a lower opening and an upper opening at their respective lower and upper portions. The lower opening and the upper opening are respectively opened beneath the liquid surface, and into the space above the liquid surface inside the tank, respectively, giving an inlet and outlet for the liquid inside the tank.

With the slim type liquid-transporting body, the size of the upper opening and the lower opening may be the same as each other, or may be different from each other. Having the lower opening larger than the upper opening is the most desirable. In this case, the ratio between the sizes of the lower opening and the upper opening may be appropriately selected based on the size of the inclination angle of the liquid-transporting body, the revolutional speed, the lift of the ejection liquid, the ejection amount, and the type of liquid.

One or a plurality of slim type liquid-transporting bodies may be arranged on one attachment device. In the case where a plurality of slim type liquid-transporting bodies are arranged on one attachment device, the upper opening pair and the lower opening pair of the slim type liquid-transporting bodies may be respectively opened either to substantially the same revolutional plane as each other, or to different revolutional planes to each other. The former is however preferable.

There is no particular limitation on the material of the liquid-transporting body. Normally this is made from a metal such as steel or stainless steel, from a transparent or opaque composite resin, from a metal with good corrosion resistance or from plastics, or from a corrosion resistant material such as glass and ceramic.

In particular, in the case where the liquid-transporting bodies are respectively the plate body, the gutter body, and the stout type liquid-transporting body (discussed later), they are preferably made of metals such as steel or stainless steel, and at least the inside and outside peripheral surfaces thereof are coated or lined with a substance having a high corrosion resistance such as a synthetic resin like polytetrafluoroethylene, or with glass, ceramic or the like.

The tubular body may be any of: a cylindrical body with the size of the diameter constant, an angled tubular body with the length of the sides or the length of the diagonal lines constant, a circular conical or an angled conical bottomless open tubular body (referred to hereunder as a conical tubular body) with the size of the diameter etc. successively changing with progress from one end to the other (hereunder the respective diameters of the tubular body and the circular conical tubular body, and the respective sides or the diagonals of the angled tubular bodies and angled conical tubular bodies are also generally referred to as "diameters etc."). With the conical tubular body, normally this is used as a conical tubular body with the small diameter upward.

The tubular body may be a straight pipe throughout. However the upper portion and central portion may be straight with the lower portion curved. Moreover, the overall shape when viewed from the side may be an approximate S-shape. In practice it is desirable to make the direction of the curved portion slightly away from the vertical or downward from the horizontal. Furthermore as desired, the upper portion of the straight pipe portion may be bent at an incline upward or at an incline downward. They may also be formed by connecting a separate pipe to the tip end of the straight pipe section of the tubular body by welding or threaded attachment or the like.

The bent portion of the tubular body is formed so that, at the junction with the straight pipe portion, on the revolution plane of this junction, this makes an angle of essentially 0° to 90° with respect to the radial direction of the revolution plane. That is to say, the bent portion is formed so as to lie along the radius of the revolution plane, or along a circumference with a radius of the distance from the agitator shaft to the junction, or along a direction tangential to the circumference. Moreover, the overall tubular body may be curved along an arc of a circle of the same radius as the distance from the agitator shaft to the attachment position of the tubular body. Furthermore, the overall tubular body may be a straight tube shape overall when viewed from above or below the revolution plane, and may be attached to the attachment device so as to be essentially 0° to 90° with respect to the radial direction of the revolution plane, as mentioned before. In the case where the liquid-transporting body is either one of a gutter body and a plate body, the arrangement is substantially no different to that for the tubular body.

There is no particular restriction to the respective shapes of the upper and lower openings of the tubular body. Normally these are for example a circular shape such as a circle, a flat oval or an ellipse, or a polygon shape such as a triangle, a square, a rectangle, a rhombus, a hexagon, or an octagon. The respective shapes of the upper and lower openings may be substantially the same as each other or may be different from each other. Preferably, the lower opening is larger than the upper opening.

The upper opening of the tubular body may be covered with a perforated plate, and may be a shower plate type with the upper opening portion as a funnel. In this case, the total area of the plurality of holes is the area of the upper opening. The upper opening portion of the tubular body may be closed off (blind). Here a plurality of holes may be pierced for the opening to give a spray type. In this case, the total area of the plurality of holes is the area of the upper opening.

The plate body serving as the slim type liquid-transporting body, may be for example a straight shape or an elongate S-shape in overall side view, while the overall shape in plan view may be for example an elongated trapezoid or rectangle, or a shape where these are curved with a slight curvature. Moreover, the plate body may be twisted such that the side of the lower portion or lower edge which follows in the revolving direction is upward.

The respective upper edge and lower edge of the plate body or the gutter body (the slim type liquid-transporting bodies) correspond respectively to the upper opening and lower opening of the tubular bodies (the slim type liquid-transporting bodies). The respective upper edge and lower edge of the plate body or gutter body (the slim type liquid-transporting bodies) are also referred to hereunder as the upper opening and the lower opening.

The gutter body serving as the slim type liquid-transporting body corresponds to a tubular body with a top face removed to form an elongate opening (this opening is referred to hereunder as a top face opening). The shape of the central transverse section, and the respective shapes of the upper opening and lower opening in the upper end rim or upper end portion and lower end rim or lower end portion have no particular limitation. It is also possible to make them a left/right symmetrical or a left/right non-symmetrical shape (referred to hereunder as symmetrical shape and non-symmetrical shape respectively), but in practice the former is preferable.

As a representative example of the symmetrical shape, the following can be considered; a circumference with part of an arc missing (referred to hereunder as a cut out circumference), a semi-circle, a semi-elliptical circumference, a half oval, a U-shape, a V-shape, polygon shapes such as; a trapezoid, a square, a rectangle, a modified pentagon shape wherein a right octagon shape has been divided in two by a straight line connecting a first point and a fifth point thereof, and a modified hexagon shape where a right octagon shape has been divided in two by a straight line connecting the central points of respective first and fifth sides thereof, as well as shapes wherein the head angles of the polygon shapes are rounded and/or the sides are bent outwards with a small curvature (referred to hereunder as substantially polygon shapes) and one side is removed.

As a representative example of the non-symmetrical shape, there are for example shapes where one of the peripheries or the sides at the edge (referred to hereunder as the opening edge) corresponding to the two peripheral edges of the opening of the beforementioned symmetrical shapes is extended (these symmetrical shapes and non-symmetrical shapes are referred to hereunder as open shapes).

The gutter body may be made as an equal sided V-shaped steel body, an H-shaped steel body, or as a C-shaped steel body wherein the transverse section is a quadrilateral of square or rectangular shape with one side missing or is circular. The C-shaped steel body is preferable. The equal sided V-shaped steel body gives a gutter body having a right angled L-shape opening. The H-shaped steel body gives a gutter body having respectively a square or rectangular shaped opening with one side missing. The C-shaped steel body wherein the transverse section shape is a quadrilateral gives a gutter body having a quadrilateral shape opening with one portion of one side missing, while the C-shaped steel body wherein the transverse section shape is circular gives a gutter body having a cut-out circumference opening. Moreover, in coating or lining the gutter body which in itself is known, then prior to coating or lining, the edges of the top surface openings are preferably rounded, or enlarged into a column shape.

With the gutter body, the respective opening areas of the upper opening and the lower opening are defined as the areas which obtain the through flow of liquid along the concavity (inner peripheral surface) of the gutter body. With the respective opening areas of the upper opening and lower opening of the gutter body, in the case where the shapes of the upper opening and lower opening are an open shape with left-right symmetry, then this is the area enclosed by the shape and a straight line connecting the opposite opening edges. In the case where the transverse section shape of the upper end rim or upper end portion and lower end rim or lower end portion of the upper opening and lower opening is a non-symmetrical open shape, then this is the area enclosed by the shape and a straight line connecting the extended portion edge and the other opening edge, or the area enclosed by the shape and a straight line connecting the opposite opening edges excluding the extended portion.

There is no particular restriction on the shape of the side of the gutter body (referred to hereunder as the side shape), however overall, normally this is a straight line, a curve which is bent at a small curvature so as to protrude upward or downward, or an S-shape wherein the upper end and/or the lower end of a straight line or the beforementioned curve are further extended in the horizontal direction or downward of the horizontal direction. For the curve, a parabola is preferable. Among other things, a straight line is preferable since this simplifies formation of the gutter body. Moreover, a curve which is bent so as to protrude downwards is preferable since this enables an increase in the liquid discharge distance and/or the discharge amount. A parabola which is bent so as to protrude downwards is particularly desirable.

There is no particular restriction on the shape of gutter body as seen from the front (referred to hereunder as the front shape), however overall, normally this is a straight line, a curve which is bent at a small curvature in the transverse direction (a direction parallel with the revolutional plane of the gutter body; defined similarly hereunder), or an S-shape wherein the upper end and/or the lower end of a straight line or the beforementioned curve are further extended in the transverse direction. However among other things a straight line is preferable.

As with the beforementioned side shape and front shape of gutter body, there is no particular restriction on the shape as seen from above or beneath (referred to hereunder as the plan shape). Overall, this is normally a straight line, a curve which is bent at a small curvature towards the direction of revolution of the gutter body or the opposite direction, or an S-shape wherein the upper end and/or the lower end of a straight line or the beforementioned curve are further extended in the transverse direction. However, among them, a straight line is preferable.

There is no particular limit to the length of the gutter body. However longer is better, and preferably this is longer than the depth of the liquid layer where the liquid transporting body is installed. Moreover, the lengths of a plurality of gutter bodies attached to the attachment device may be the same as each other, or may be different from each other.

Two or more gutter bodies may be connected side-by-side. For example, two gutter bodies are arranged in parallel so that one of edges of opening of a gutter body is connected alongside to that of another gutter body next positioned. Instead, a partition wall may be positioned in an axial direction inside the gutter body to form two separate canals.

In order to dispersingly eject the liquid from the upper opening of the gutter body as a spray, as minute droplets, or as a fine flow, then the whole of the upper opening of the gutter body may be covered with a perforated plate drilled with a plurality of holes, or with a mesh. This too is preferable. With respect to the perforated plate, the plurality of holes may be pierced regularly or irregularly. There is no particular restriction on the shape and number of holes. As a representative example of the shape of the holes, these may be circular, elliptical, square, or rectangular. As to the gutter body, the upper opening may be closed off by a plate so that a gap is formed along the inner peripheral surface of the gutter body. Furthermore, the top face opening of the gutter body, may be covered with an opaque or transparent cover which is removable. Moreover, a deflector plate may be provided spaced apart from the upper opening of the gutter body, to thereby abruptly change the direction of the liquid ejected therefrom.

Furthermore, the gutter body may be twisted sufficiently to obtain raising of the liquid. Moreover, the gutter body may be free to turn about the longitudinal axis thereof. In these cases, the angle through which the gutter body is twisted or turned about itself is appropriately selected depending for example on the shape of the opening and the size of the inclination angle of the gutter body, the viscosity of the liquid in the container, and the revolutional speed of the gutter body. In the case of the latter, the gutter body may be mounted on the attachment device so as to be able to be turned about itself. In this case the gutter body may also be secured after being turned to an optional deviation angle. Moreover, this can be turned about itself automatically depending on the revolutional speed of the gutter body. In this case, the gutter body is mounted on the agitator shaft so as to be freely rotatable about itself.

Furthermore, the gutter body is attached to the agitator shaft via the attachment device with the concavity or the top face opening of the gutter body facing inside of a revolving circle thereof, preferably towards the agitator shaft or the revolution direction. The extent that the concavity or the top face opening of the gutter body faces the agitator shaft is indicated by a deviation angle. The deviation angle is defined as being the same as the declination angle. Here, if A, B and C are optionally selected in order from a preceding area towards the following area according to revolution direction, in the horizontal cross-section at the openings of the gutter body or in the revolution plane of the gutter body, and D is the rotation axis (the center of the agitator shaft; defined similarly hereunder) on the same cross-section as above. These points A, B, C, and D satisfy the following conditions:

(1) the distance between B and D is greater than or equal to the distance between C and D;

(2) the angle ABD subtended by the line segment AB and the base line BD, and the angle CBD subtended by the line segment BC and the base line BD are named as $\theta_1$ and $\theta_2$, respectively.

A. in the case where the gutter body is revolved in the clockwise direction or to the right direction about the axis D, for $\theta_1$, (+) sign is given, when it is within the preceding area before the base line BD, while (−) sign is given when it is within the following area behind the base line BD; but for $\theta_2$, (−) sign is given, when it is within a following area behind the base line BD while (+) sign is given when it is within a preceding area before the base line BD;

B. in the case where the gutter body is revolved in the counter-clockwise direction or to the left direction, the same signs as in A above are given to $\theta_1$ and $\theta_2$, respectively, i.e., (+) sign is given to $\theta_1$ when $\theta_1$ is within a preceding area before the base line BD.

Preferable range of $\theta_1$ and $\theta_2$ are $$-75° \leqq \theta_1 \leqq 110°$$

$$-75° \leqq \theta_2 \leqq 110°.$$

Moreover, the declination angle is shown as $(\theta_1+\theta_2)/2$. Consequently, the declination angle is zero when the respective absolute angles of $\theta_1$ and $\theta_2$ are equal to each other.

The declination angle is appropriately selected in the beforementioned range, depending for example on the shape of gutter body itself and the opening shape, the opening area ratio between the upper and the lower openings, and the use of the ejected liquid.

When attaching the gutter body to the attachment device, the arrangement must be such that the attachment device does not obstruct the rising of the liquid within the concavity of the gutter body.

The turning about the revolving axis of the plate liquid-transporting body is the same as for the gutter body liquid-transporting body.

With the slim type liquid-transporting body, one of a plurality of through holes may be pierced in the wall thereof, and this is preferable. A plate may be fitted spaced apart from the outer side of the through hole (the side close to the peripheral wall of the tank; defined similarly hereunder). By means of this plate, the ejection direction of the ejection liquid ejected from the upper opening can be changed. Furthermore, a pipe and spray nozzle may be attached to the slim type liquid-transporting body, radiating out from the outside of the through hole (the opposite side to the agitator shaft; defined similarly hereunder). The liquid passing along the slim type liquid-transporting body may also be ejected to the outside from a through hole pierced in the wall of the slim type liquid-transporting body. By selecting the size of this through hole, then a desired quantity of liquid passing along the slim type liquid-transporting body can be discharged from the through hole. The slim type liquid-transporting body may be bendable and/or able to be telescoped. To make the slim type liquid-transporting body bendable, then for example the liquid-transporting body may be made from a flexible material, or the slim type liquid-transporting body may be divided up transversely (substantially perpendicular to the longitudinal axis) into a plurality of sections, and these sections connected by joint members so as to be able to pivot relative to each other. In order to enable telescoping of the slim type liquid-transporting body, then for example the slim type liquid-transporting body may be divided up transversely into a plurality of sections, and these sections connected so as to be slidable lengthwise relative to each other.

In the case where a plurality of the slim type liquid-transporting bodies are secured to the attachment device, then these may be arranged independent from the attachment device, or may be formed integral with the attachment device. As a representative example of where the gutter body is attached integral with the attachment device, there is for example a gutter body which is formed from a plate body which constitutes the attachment device, the gutter body being formed by bending opposite the whole of non horizontal side portions of the plate body along the side. In the case wherein the plate body constitutes the attachment device, normally, ideally, the plate body is in the shape of a triangle, an inverted trapezoid, or a quadrilateral such as a rectangle or square. However, there is not objection to plate bodies of shapes other than the above. With the gutter body formed in this manner, the respective shapes of the upper and lower openings are non symmetrical. With the plate body which constitutes the attachment device, the unbent flat portion acts as an agitator blade. To prevent the fluid resistance of the plate body constituting the attachment device becoming excessive, openings may be formed in the flat portion of the plate body to reduce the fluid resistance at this part. This is desirable.

The slim type liquid-transporting body is attached parallel with the agitator shaft or in a radiating arrangement with the lower opening closer to the agitator shaft than the upper opening. In the case of the latter, the slim type liquid-transporting body is preferably centripetally attached to the attachment device with the longitudinal axis coinciding with the radial direction in the revolution plane corresponding to the attachment location of the attachment device, because a large amount of liquid is ejected from the upper opening. This may be attached eccentrically, in a direction differing from the radial direction. In the case where the slim type liquid-transporting body is attached eccentrically, then the longitudinal axis of the slim type liquid-transporting body may be parallel with the radial direction in the revolution plane corresponding to the attachment location of the attachment device. Moreover this may be at an incline. In the case where this is eccentric and at an incline, then preferably the eccentricity is such that the lower opening of the liquid-transporting body leads at the time of revolution.

With the stout type liquid-transporting body, the upper base opening and the lower base opening are respectively the upper opening and the lower opening. The agitation shaft passes through the centers of the upper and lower openings. The stout type liquid-transporting body, and the agitator shaft are connected by the attachment device.

The liquid-transporting body may be secured to the attachment device at an inclination angle of a predetermined size, or may be mounted so that the size of the inclination angle can be optionally adjusted. The latter is preferable. Here the inclination angle, in the case of the slim type liquid-transporting body, is defined as the angle subtended between the longitudinal axis and the revolution plane of the slim type liquid-transporting body. Moreover, in the case of the stout type liquid-transporting body, this is defined as the angle subtended between the generating line of the wall of the tubular body and the revolution plane of the stout type liquid-transporting body. The method of securing may involve a routine procedure such as interference fitting, welding, or bonding. Here the longitudinal axis of the slim type liquid-transporting body is defined as the line connecting the respective centers or central points of the upper opening and lower opening of the liquid-transporting body.

Furthermore, the inclination angle of the liquid-transporting body is in the range from 0° to 90°. As a result, with the slim type liquid-transporting body, the lower opening thereof is closer to the agitator shaft than the upper opening, or the distance from the agitator shaft to the lower opening and the upper opening is substantially the same for each. In practice however the former is preferable. In the case of the latter, when the slim type liquid-transporting body is a gutter body, then preferably the lower opening is covered over. In this case also, the liquid at the immersed portion of the gutter body is raised in the gutter body.

The inclination angle of the liquid-transporting body is appropriately selected according to the shape of the liquid-transporting body itself, the shape of the opening, the opening area ratio between the upper and the lower openings, the type of liquid, the revolution speed of the liquid-transporting body, the lift of the ejection liquid (the height reached by the ejection liquid on the inner peripheral surface of the tank peripheral wall; defined similarly hereunder), the ejection distance, and the ejection quantity. Normally, around 5°–85° is suitable.

In order to mount the slim type liquid-transporting body on the agitator shaft so that the inclination angle can be adjusted, then for example this may be mounted with the lower end portion of the slim type liquid-transporting body hinged to the agitator shaft, and the upper opening of the slim type liquid-transporting body movable centripetally or centrifugally in the radial direction of the revolution plane by means of a vertical travelling device or a horizontal travelling device. Here the vertical travelling device and the horizontal travelling device are respectively, a device whereby the upper portion (the free end) of the slim type liquid-transporting body is lifted up or pushed down vertically to thereby adjust the inclination angle of the slim type liquid-transporting body, and a device whereby the upper portion (the free end) of the slim type liquid-transporting body is pulled in or pushed out horizontally to thereby adjust the inclination angle of the slim type liquid-transporting body. In the above, movement of the upper opening of the slim type liquid-transporting body is by a vertical travelling device or by a horizontal travelling device. Hereunder these are referred to as a vertical system and a horizontal system respectively.

The slim type liquid-transporting body can be inclined by making the length of the slim type liquid-transporting body longer than the radius in the revolution plane thereof, hinging the lower end of the transporting body to the agitator shaft, and slidingly contacting the upper end thereof against the inner peripheral surface of the tank. In this case, the inclination angle of the slim type liquid-transporting body can be adjusted by changing the length thereof. Moreover, by making the length of the slim type liquid-transporting body longer than the coil diameter of the coiled pipe installed in the tank (the distance from the center of the coiled pipe to the inside circumference), and hinging the lower end of the transporting body to the agitator shaft, the slim type liquid-transporting body can be inclined by slidingly contacting the lower end thereof against the upper end inner peripheral surface of the coiled pipe. In this case, by changing the attachment position of lower end of the slim type liquid-transporting body (the distance from the tank bottom surface), the inclination angle of the slim type liquid-transporting body can be adjusted.

The attachment device with the liquid-transporting body attached thereto is attached to the agitator shaft, with the lower opening of the liquid-transporting body immersed beneath the liquid surface, and the upper opening exposed from the liquid surface. By rotating the agitator shaft and hence revolving the liquid-transporting body, the liquid at the immersed portion of the liquid-transporting body is raised inside the liquid-transporting body in accordance with Bernoulli's theorem, and due to centrifugal force, and is ejected from the upper opening. Together with this, the portion of the liquid-transporting body beneath the liquid surface acts as an agitator blade, and the liquid is agitated by this portion.

In the stout type liquid-transporting body, the upper base opening and the lower base opening respectively constitute the upper opening and the lower opening, and the inner peripheral surface of the tubular body of stout type liquid-transporting body constitutes the liquid flow path.

With the liquid ejection method of the present invention, the revolutional speed of the liquid-transporting body is appropriately selected depending on the liquid depth inside the tank, the inclination angle of the liquid-transporting body, the type of liquid-transporting body, the shape and size (stout or slim) of the liquid-transporting body, and the type of liquid.

Revolution of the liquid-transporting body makes liquid level up at the circumferencial surface of the tank wall but down around the agitator shaft to form a funnel shape, until the liquid level is lower than the lower opening of the liquid-transporting body and no raise of liquid is seen. At this time, the liquid level is returned to the usual by revolving the transporting body in a reverse direction. The rotational speed of the agitator shaft is increased in accordance with the drop in the liquid level inside the tank, and corresponding to this, the revolutional speed of the liquid-transporting body is also increased.

In this way, the liquid inside the tank is distributed into the space above the liquid surface in the tank interior and/or to a location at a desired height on the inner peripheral surface of the tank.

The liquid ejected from the upper opening of the liquid-transporting body is used for the following;

(a) for distributing onto the foam layer formed on the surface of the liquid inside the tank to disperse the foam;

(b) for distributing onto the inner peripheral surface of the tank to wash the inner peripheral surface thereof;

(c) for distributing onto the heat transfer surface of the heating and cooling equipment installed inside the tank to thereby wash the heat transfer surface;

(d) in the case where the liquid level in the tank drops, for distributing onto the inner peripheral surface of the tank which serves as a heat transfer surface, or onto the heat transfer surface of the heating or cooling equipment installed inside the tank, to maintain the heat transfer area; and/or (e) for distributing into the space above the liquid surface inside the tank to promote evaporation of the liquid inside the tank.

In the case of e) above, the tank may be kept under reduced pressure or under pressure. In the former case, the liquid drops distributed boil immediately and evaporate. In the case of c), the liquid forms a film on the heat transfer surface and is heated or cooled in a short time. Time for heating or cooling liquid is shortened to save energy loss.

There is no particular restriction to the size of the liquid ejection apparatus of the present invention, and this may be an optional size. Normally, when used for example inside a large size tank at a manufacturing plant of a factory, then a large scale device is desirable, while when used for example inside a small-scale flask, then this can be a laboratory type small scale apparatus.

With the liquid ejection apparatus of the present invention installed inside a flask, then either of the slim type liquid-transporting body and the stout type liquid-transporting body can be used. In the case where the liquid-transporting body is the slim type liquid-transporting body, the upper end thereof is first moved close to the agitator shaft so that the inclination angle of the liquid-transporting body approaches 90°. Then after making the liquid-ejection apparatus narrow in this way, this is passed through the opening of the flask and installed inside the flask. After this, the liquid-transporting body is opened and secured at the desired inclination angle. Moreover, the upper end of the slim type liquid-transporting body may be slidingly contacted against the surface of the flask to give a predetermined inclination angle. Furthermore, the inclination angle of the slim type liquid-transporting body can be adjusted by the vertical system while inside the flask. In the case where the liquid-transporting body is the stout type liquid transporting body, then the flask is normally a separable flask. The liquid may be viscous one or suspension having large concentration of dispersoid.

Other objects and aspects of the present invention will become apparent from the following description of embodiments, given in conjunction with the appending drawings.

DESCRIPTION OF THE PREFERRED EMBODIMENTS

Figure 1:
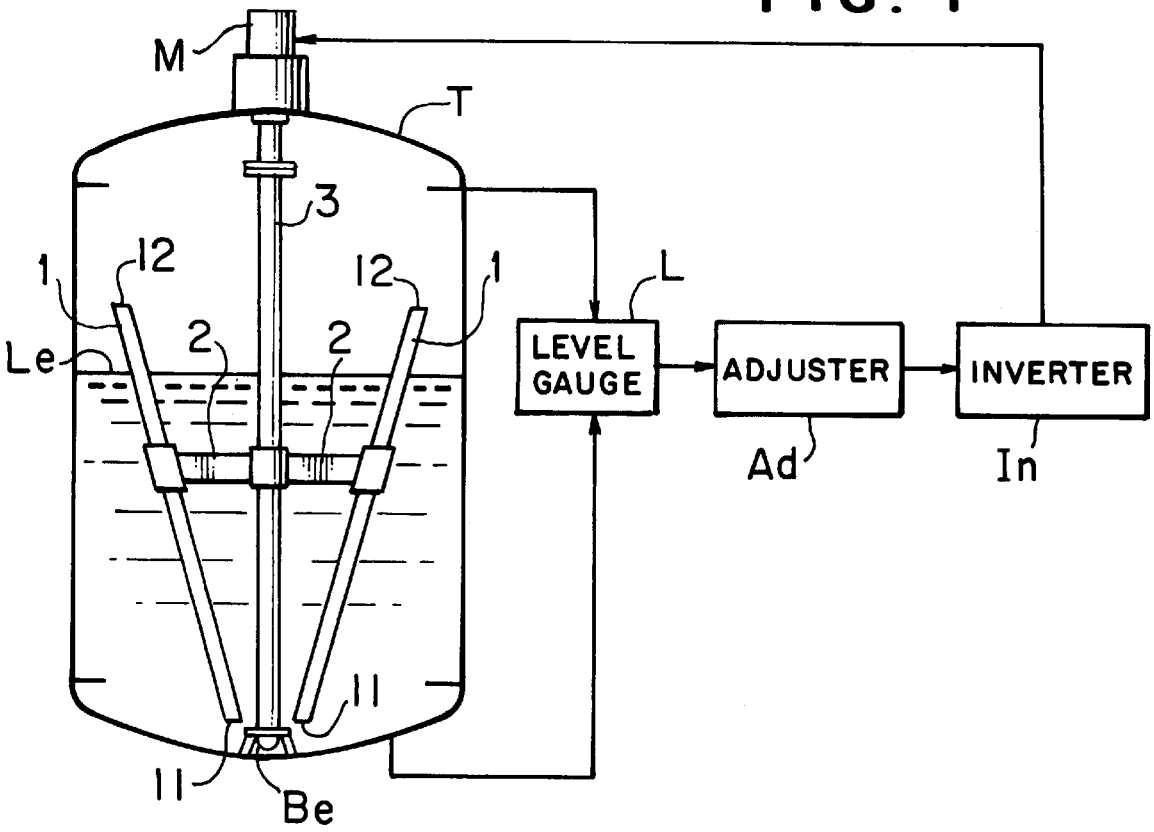
FIG. 1 shows a liquid-ejection apparatus of the present invention installed in a tank.

The present invention will now be described more specifically by means of embodiments shown in the drawings. However the invention is not limited to these embodiments.

The drawings are typical drawings for illustrating the theory of the present invention, and the relative size etc. is not shown accurately. Moreover, in the figures, thicknesses of the materials in the respective cross-sections of, for example, the tank top plate, bottom plate, and peripheral walls, and the jacket and the like are omitted.

Figure 2:
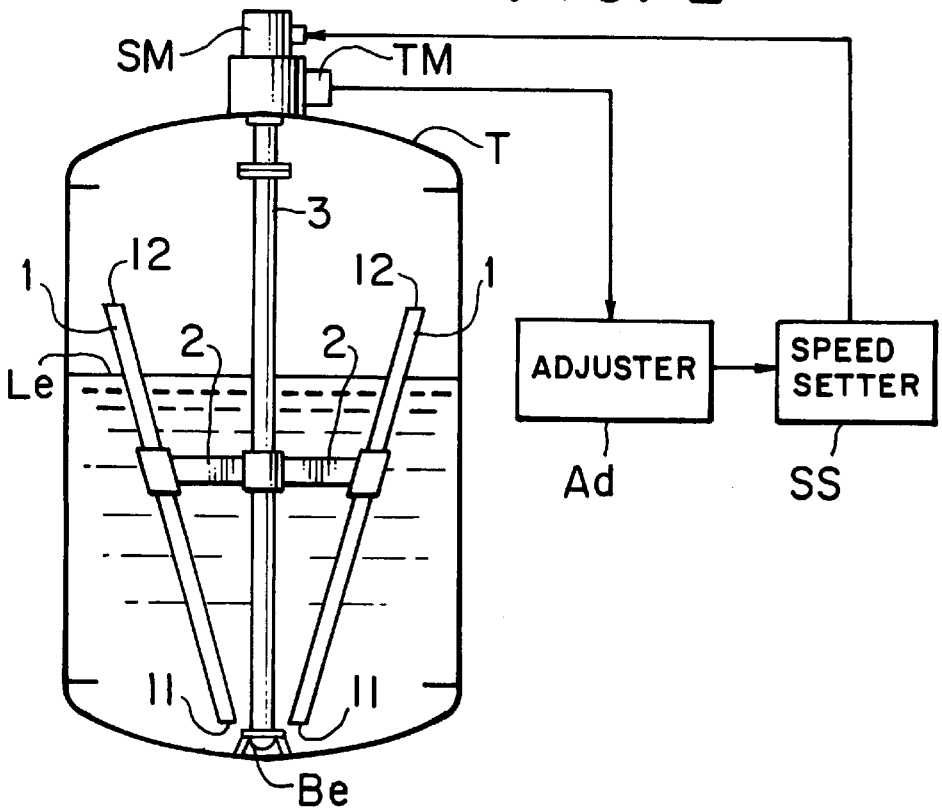
FIG. 2 shows another liquid-ejection apparatus of the present invention installed in a tank.
Figure 3A:
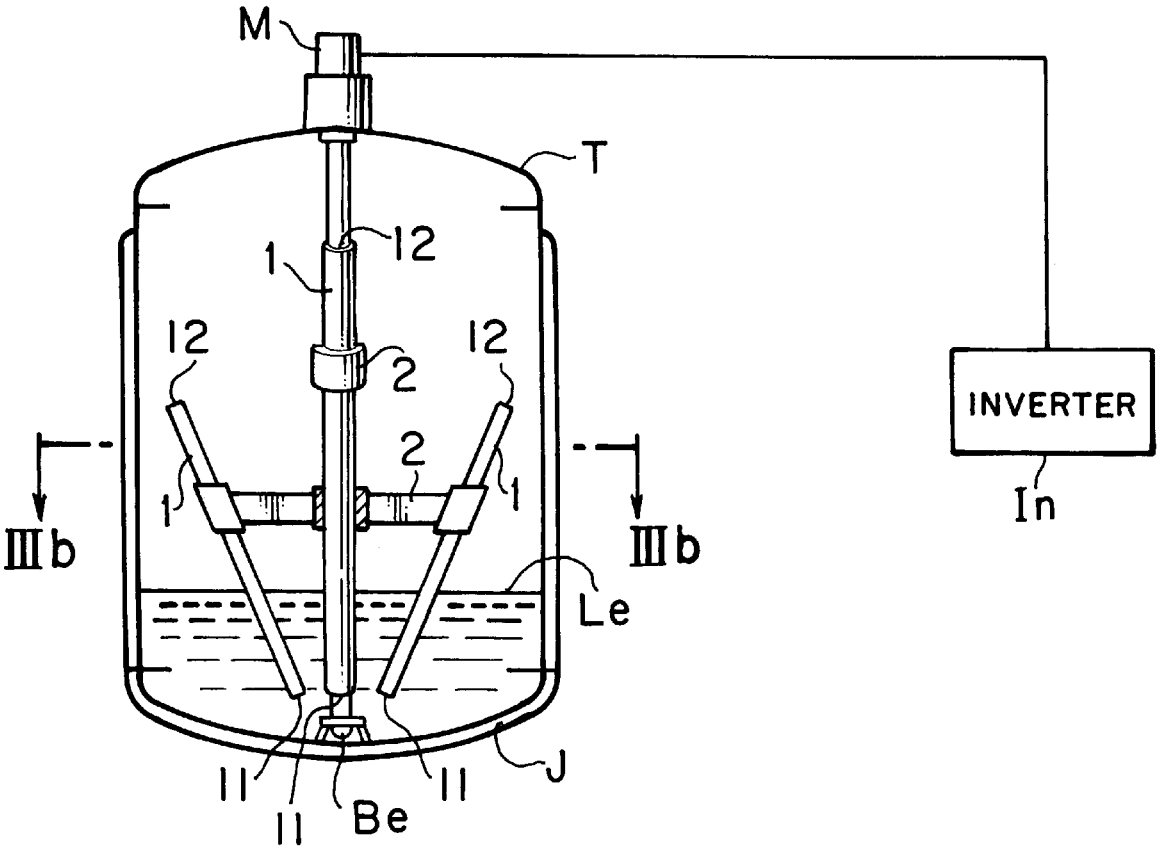
FIG. 3*a* shows a front view of a liquid-ejection apparatus of the present invention installed in a tank.
Figure 3B:
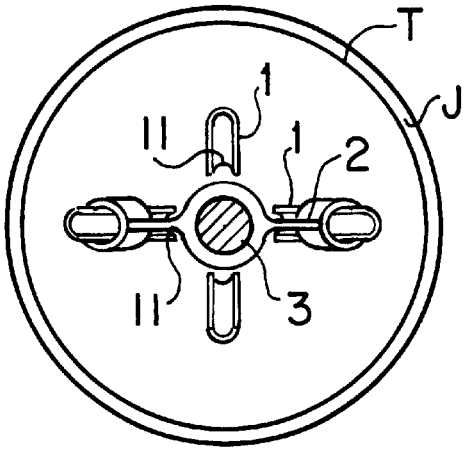
FIG. 3*b* shows a cross-sectional view along a line IIIb—IIIb in FIG.3*a;*

In FIG. 1, FIG. 2. FIG. 3*a* and FIG. 3*b*, only the tank is shown as a longitudinal cross-section view.

With the apparatus shown in FIG. 1 and FIG. 2, gutter body 1 inside a tank T is the liquid-transporting body. One gutter body 1 is secured at an incline to the tip of an attachment device 2 in the form of a conical plate, with a lower opening 11 closer to an agitator shaft 3 than an upper opening 12. The lower opening 11 of the gutter body 1 is immersed in liquid, while the upper opening 12 is opened in the space above the liquid surface Le. The attachment device 2 is secured to the agitator shaft 3. The agitator shaft 3 is supported at a lower end thereof by a bearing Be secured to an inner surface of a bottom plate of the tank T. Moreover, the upper end is connected to a prime mover for driving the agitator shaft, which is secured to an outside surface of a top plate of the tank T.

In FIG. 1, the prime mover for driving the agitator shaft is an electric motor M. A level gauge L, an adjuster Ad, and an inverter In serving as a rotational speed change apparatus are provided outside the tank T. The electric motor M and the level gauge L are connected via the adjuster Ad and the inverter In. By rotating the agitator shaft 3, then the gutter bodies 1 are revolved about the periphery of the agitator shaft 3 so that the liquid at the liquid immersed portion of the gutter body 1 is raised inside the gutter body 1, and ejected from the upper opening 12 of the gutter body 1 and thereby distributed.

The liquid depth, which changes moment by moment inside the tank T, is detected by the level gauge L, and a signal for the liquid depth is generated from the level gauge L. This signal is transmitted sequentially via the adjuster Ad and the inverter In to the electric motor M so that the electric motor M is rotated at a speed corresponding to the liquid depth inside the tank.

In FIG. 2, instead of the prime mover for driving the agitator shaft being the electric motor M as with the liquid ejection apparatus of the invention shown in FIG. 1, this is a speed adjusting electric motor SM, instead of the level gauge L there is a torque meter TM, and instead of the inverter In constituting the rotational speed change apparatus, there is a speed setter SS. The size of the torque in the agitator shaft 3, which changes movement by moment with the change in the liquid depth, is detected by the torque meter TM and a signal from the torque meter TM is generated for the size of the torque of the agitator shaft 3. This signal is transmitted sequentially via the adjuster Ad and the speed setter SS to the speed adjusting electric motor SM. Apart from this, there is essentially no difference.

With the apparatus shown in FIG. 3*a* and FIG. 3*b*, a jacket J serving as a heating or cooling device is provided on the outer surface of the tank T. Moreover, two groups of gutter bodies 1 (two short gutter bodies and two long) are respectively attached to attachment devices 2 which arc orthogonal to each other. The prime mover for driving the agitator shaft is an inverter motor M which controls the rotation speed of the shaft.

Here, short liquid-transporting bodies 1 are attached to one of the orthogonally arranged attachment device 2, and long liquid-transporting bodies 1 are attached to the other. The lower openings 11 of the two long and two short liquid-transporting bodies are opened on approximately the same revolution plane at the bottom portion of the tank T, while the upper openings 12 of the short liquid-transporting bodies 1 are opened towards the inner peripheral surface of the central portion of the peripheral wall of the tank T, and the upper openings 12 of the long liquid-transporting bodies 1 are opened towards the upper portion of the peripheral wall of the tank T.

By rotating the agitator shaft 3, then the short and long two groups of gutter bodies 1 are revolved about the agitator shaft 3, so that the liquid at the liquid immersed portion of the respective gutter bodies 1 is raised inside the gutter bodies 1 and respectively ejected from the upper openings 12 of the short gutter bodies 1 and the upper openings 12 of the long gutter bodies 1, and distributed onto the inner peripheral surfaces of the upper and central portions of the peripheral wall of the tank T being the heat transfer surface of the jacket J. Here the gutter bodies 1 are also used as agitator blades.

Load of the inverter motor M, which changes moment by moment with the change in liquid depth in the tank T, so that torque becomes a given value, is detected by the inverter itself wherein calculation is made until frequency and then rotation speed are changed accordingly. In the apparatus shown in FIG. 1, FIG. 2, FIG. 3*a* and FIG. 3*b*, rotation speeds of the motor M and the motor SM are increased as liquid depth in the tank T becomes small. Rotation speed of the agitator shaft 3 is increased accordingly.

Figure 4A:
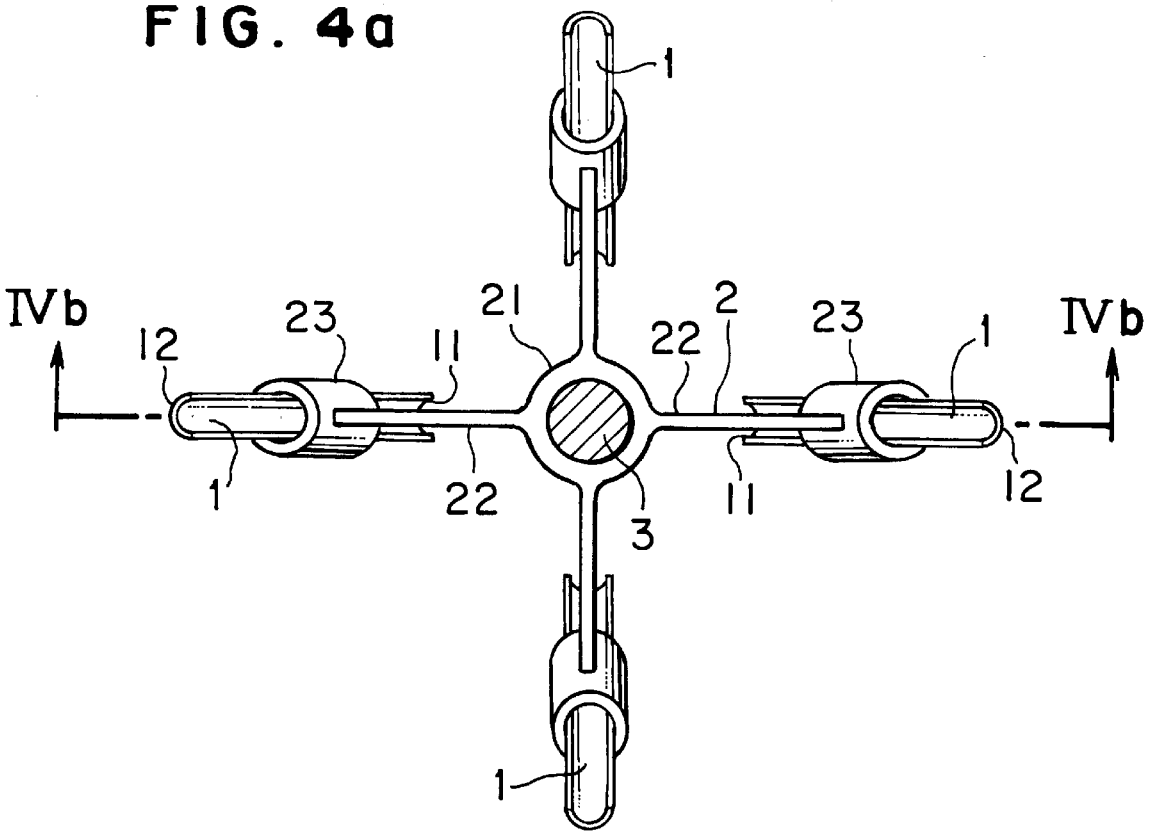
FIG. 4*a* shows a plane view of a detail view of an attachment part for a slim type liquid-transporting body of a liquid-ejection apparatus of the present invention.
Figure 4B:
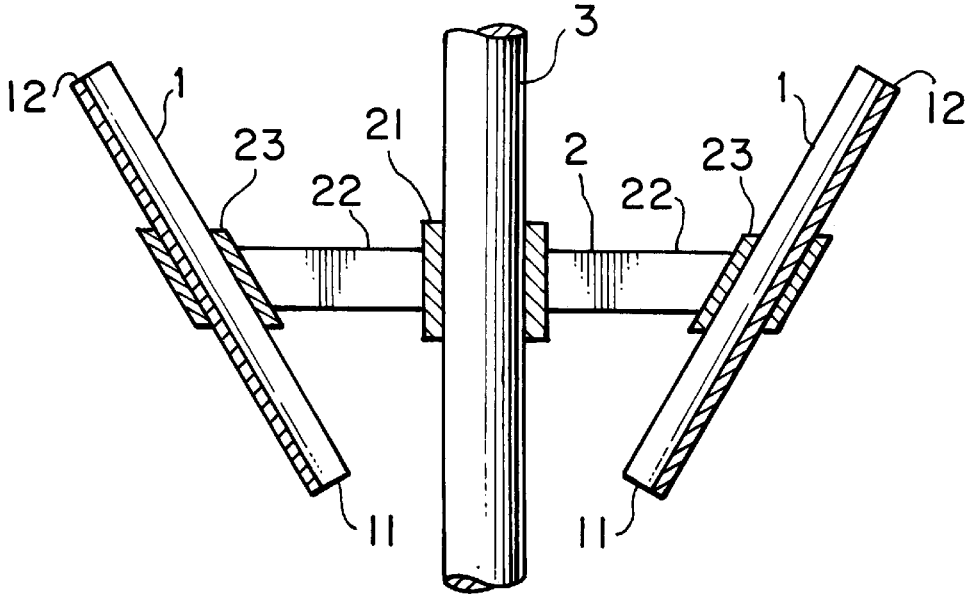
FIG. 4*b* shows a cross-sectional view along a line IVb—IVb in FIG. 4*a;*

FIG. 4*a* and FIG. 4*b* show the condition with the gutter body serving as the slim type liquid-transporting body, installed by securing to the agitator shaft by means of the attachment device. With this liquid-ejection apparatus, gutter bodies 1 are fixedly mounted at an incline to an agitator shaft 3 by means of an attachment device 2. The gutter body 1 is a cylinder which has been longitudinally sectioned along a face including the center of the base (referred to hereunder as half cutting). This cut face is the top face opening. Shapes of the central portion, the upper opening and lower opening are semi-circular. The attachment device 2 comprises plates 22 secured to a central ring 21 and radiating out at a central angle of 90°. Retainers 23 for holding the gutter bodies 1 are provided on the tips thereof. The agitator shaft 3 is passed through the central ring 21, and the attachment device 2 is then fixedly secured to the agitator shaft 3.

The plates 22 are long rectangular flat plates with an inclined tip. The surfaces thereof are aligned parallel with the axial direction of the agitator shaft. The retainers 23 are tubes having inner radii equal to the outer radii of the gutter bodies 1. The gutter bodies 1 are passed through and secured to the retainers 23 of the attachment device 2, with lower openings 11 thereof arranged closer to the agitator shaft 3 than upper openings 12. Furthermore, the concavities and the top face openings are arranged facing inwards towards the agitator shaft, and such that the retainers 23 of the attachment device 2 do not obstruct the liquid rising in the concavities. Moreover, the inclination angles of the gutter bodies 1 are made approximately 60°.

Figure 5A:
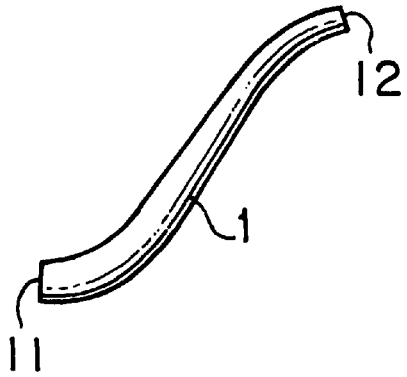
FIG. 5*a*–FIG. 5*c* show a side view, a front view and a perspective view, respectively, of an example of a gutter body slim type liquid-transporting body.
Figure 5B:
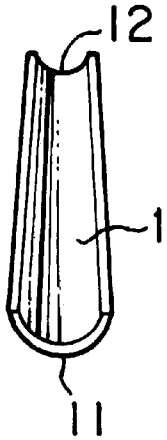
Figure 5C:
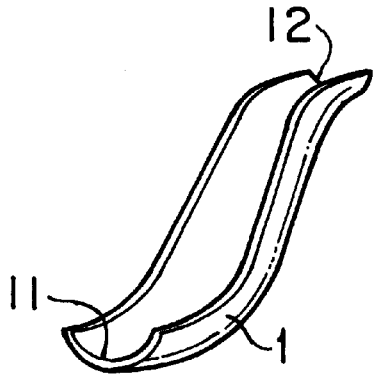

The gutter body 1 shown in FIG. 5*a*–FIG. 5*c* is approximately an elongated bottomless half cut hollow cone. The transverse sectional shape of the central portion, and the respective shapes of the lower opening 11 and the upper opening 12 are all semi-circular. Furthermore, the side shape is an overall elongated S-shape, with the central portion a straight line and the lower end and the upper end extended approximately horizontally towards the center and towards the periphery respectively in the rotation plane.

Figure 6A:
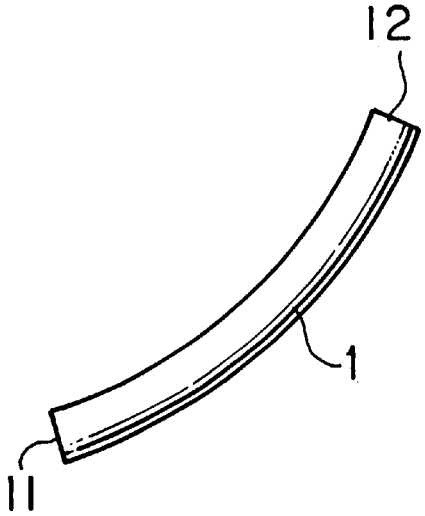
FIG. 6*a* and FIG. 6*b* show a side view and a front view, respectively, of another example of a gutter body slim type liquid-transporting body.
Figure 6B:
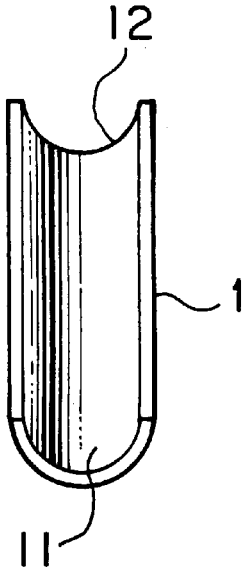

The gutter body 1 shown in FIG. 6*a* and FIG. 6*b* is approximately an elongated bottomless half cut circular tube. The transverse sectional shape of the central portion, and the respective shapes of the lower opening 11 and the upper opening 12 are all semi-circular. Furthermore, the side view shape is a parabola shape protruding downwards with a small curvature.

Figure 7A:
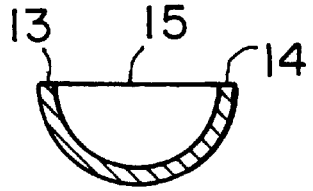
FIG. 7*a*–FIG. 7*l* show respective symmetrical shapes for transverse sections of central portions, and for openings of gutter body slim type liquid-transporting bodies.
Figure 7B:
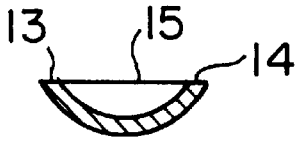
Figure 7C:
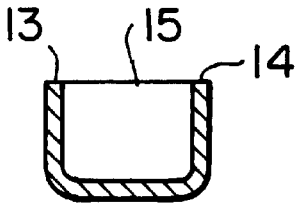
Figure 7D:
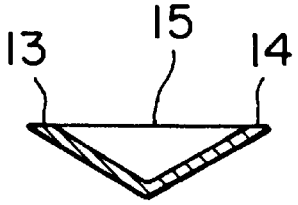
Figure 7E:
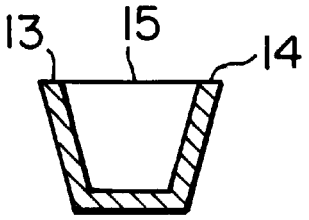
Figure 7F:
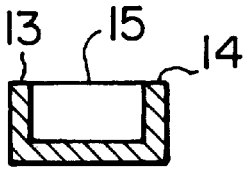
Figure 7G:
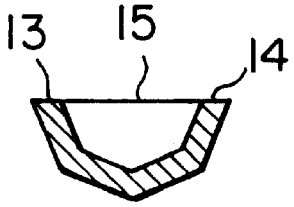
Figure 7H:
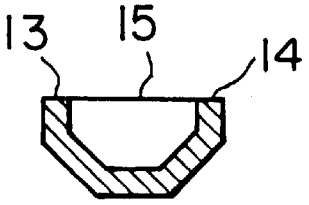
Figure 7I:
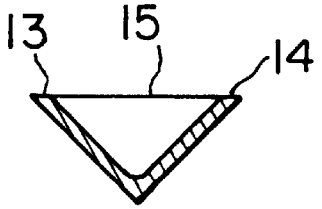
Figure 7J:
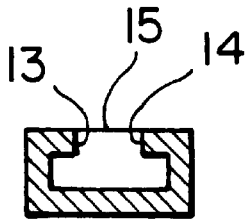
Figure 7K:
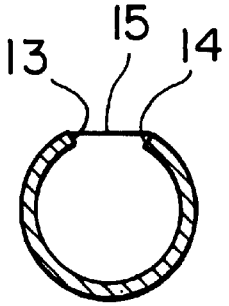
Figure 7L:
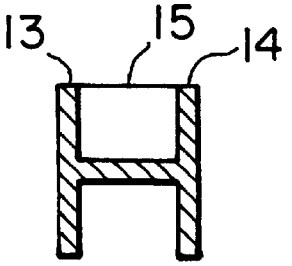
Figure 8A:
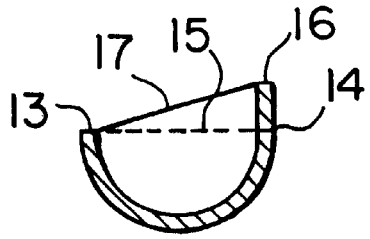
FIG. 8*a*–FIG. 8*k* show respective non-symmetrical shapes for transverse sections of central portions, and for openings of gutter body slim type liquid-transporting bodies.
Figure 8B:
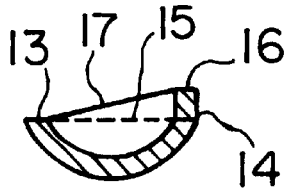
Figure 8C:
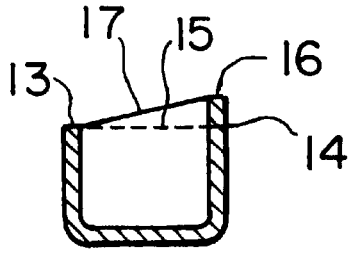
Figure 8D:
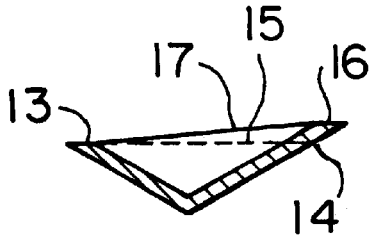
Figure 8E:
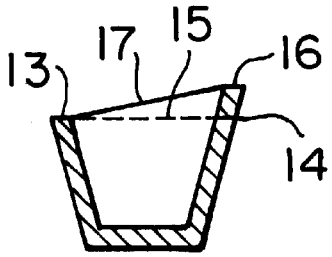
Figure 8F:
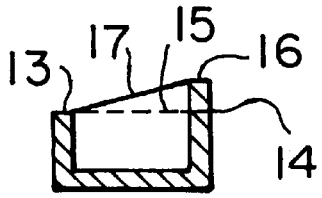
Figure 8G:
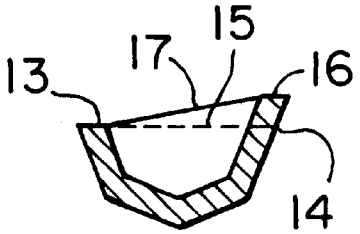
Figure 8H:
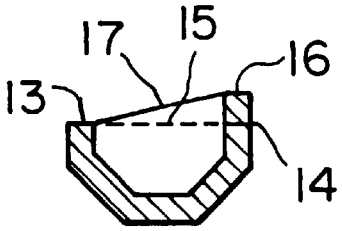
Figure 8I:
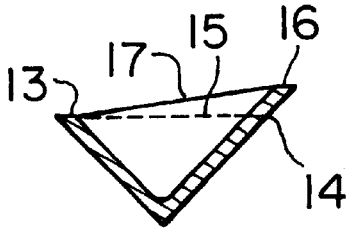
Figure 8J:
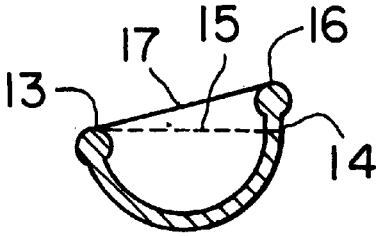
Figure 8K:
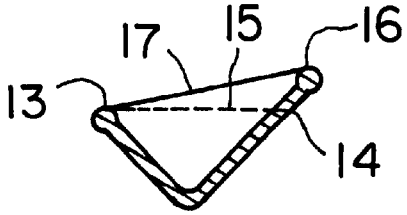

In FIG. 7*a*–FIG. 7*h*, FIG. 7*a* is a semi-circle, FIG. 7*b* a semi-ellipse being an ellipse which has been cut into two equal parts along the longitudinal axis), FIG. 7*c* a U-shape, FIG. 7*d* a V-shape with an obtuse angle, FIG. 7*e* an inverted trapezoid with the bottom missing (a trapezoid with the upper base (short side) and the lower base (long side) respectively arranged at the bottom and the top; defined similarly hereunder), FIG. 7*f* a rectangular shape with one long side missing, FIG. 7*g* a modified pentagon shape wherein a right octagon shape has been divided in two by a straight line connecting a first point and a fifth point thereof, and FIG. 7*h* a modified hexagon shape wherein a right octagon shape has been divided in two by a straight line connecting the central points of respective first and fifth sides thereof.

With these gutter bodies, there is an opening border 15 between opening edges 13 and 14. Moreover the cross-sectional area of the opening is the area of the shape enclosed by the inner peripheral surface of the gutter body and the opening border 15. In FIG. 7*i*, FIG. 7*j*, FIG. 7*k* and FIG. 7*l*, they respectively show the transverse sectional shapes of the central portions of the gutter body, FIG. 7*i* being an equal sided V-shape section, FIG. 7*j* a C-section with a rectangular transverse section, FIG. 7*k* a C-section with a circular transverse section, and FIG. 7*l* an H-section, and the respective shapes of the upper opening and the lower opening.

These non-symmetrical shapes shown in FIG. 8*a*–FIG. 8*k* correspond substantially to the symmetrical shapes shown in FIG. 7*a*–FIG. 7*i*.

With these gutter bodies, there is an opening border 17 between the opening edge 13 and the extended portion edge 16. Moreover, the cross-sectional area of the opening is the area enclosed by the symmetrical shape of the inner peripheral surface of the gutter body and the aforementioned opening border 15 thereof, or the area enclosed by the inner peripheral surface of the non-symmetrical shape of the gutter body and the opening border 17. The gutter body having a transverse section and openings of a non-symmetrical shape as shown in FIG. 8*a*–FIG. 8*k*, is preferably revolved with the opening edge 13 preceding and the extended edge portion 16 following.

Figure 9A:
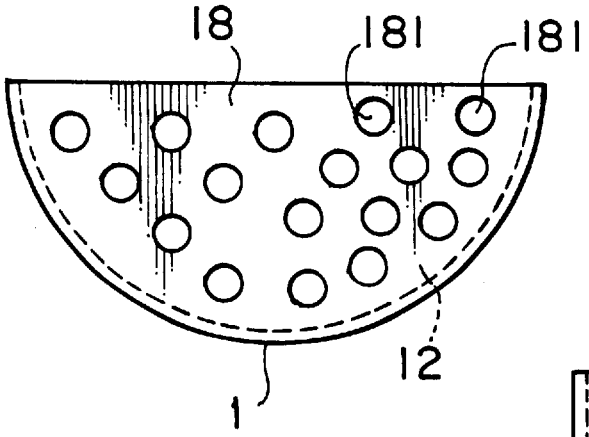
FIG. 9*a* and FIG. 9*b* show examples of upper openings of gutter bodies which are covered by semi-circular and rectanguar perforated plates, respectively.
Figure 9B:
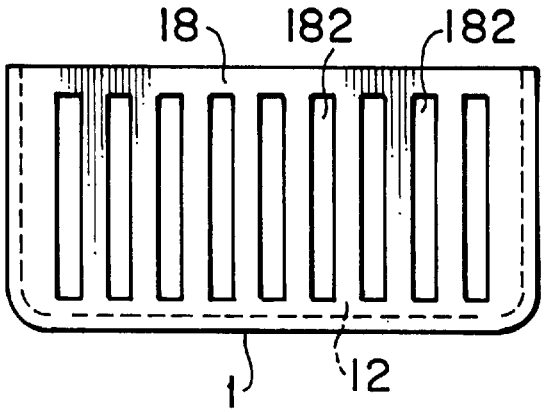

In FIG. 9*a*, an upper opening 12 of a semi-circular gutter body 1 is covered by a perforated plate with a plurality of small circular holes 181 randomly drilled in a semi-circular plate 18 in a shape corresponding to the upper opening 12. Furthermore, a substantially rectangular shape upper opening 12 of a gutter body 1 shown in FIG. 9*b*, having corners rounded at two places is covered by a perforated plate, being a plate 18 which is substantially rectangular in shape with rounded corners corresponding to the upper opening 12, and having a plurality of elongate rectangular apertures 182 formed regularly therein with their longitudinal axes parallel with each other.

Figure 10A:
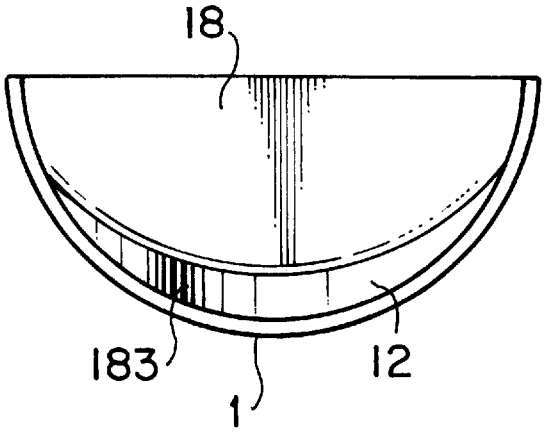
FIG. 10*a* and FIG. 10*b* show upper openings of gutter bodies which are partly closed off by semi-circular and rectangular plates such that gaps are formed along inner peripheral surfaces of the upper openings.
Figure 10B:
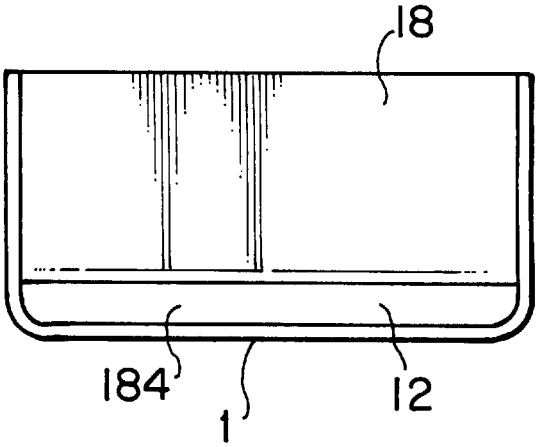

In FIG. 10*a*, the upper opening 12 of the gutter body 1 is semi-circular in shape while the shape of the plate 18 is a semi-ellipse having a longitudinal axis of a length equal to the diameter of the semi-circle of the upper opening 12 of the gutter body 1. Hence there is provided a crescent moon shape gap 183. In FIG. 10*b*, the upper opening 12 of the gutter body 1 is substantially rectangular in shape with the corners rounded at two places, while the shape of the plate 18 is rectangular, with the long side equal to the length of the long side of the substantially rectangular upper opening 12, and the short side shorter than the length of the short side thereof. Hence there is provided a narrow substantially rectangular shape gap 184 with corners rounded at two places.

Figure 11A:
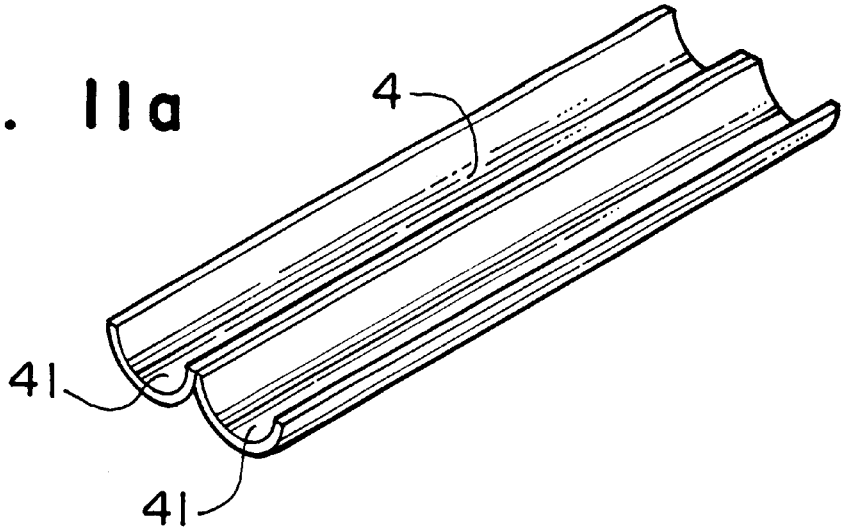
FIG. 11*a*–FIG. 11*c* show perspective views of three types of connected gutter bodies.
Figure 11B:
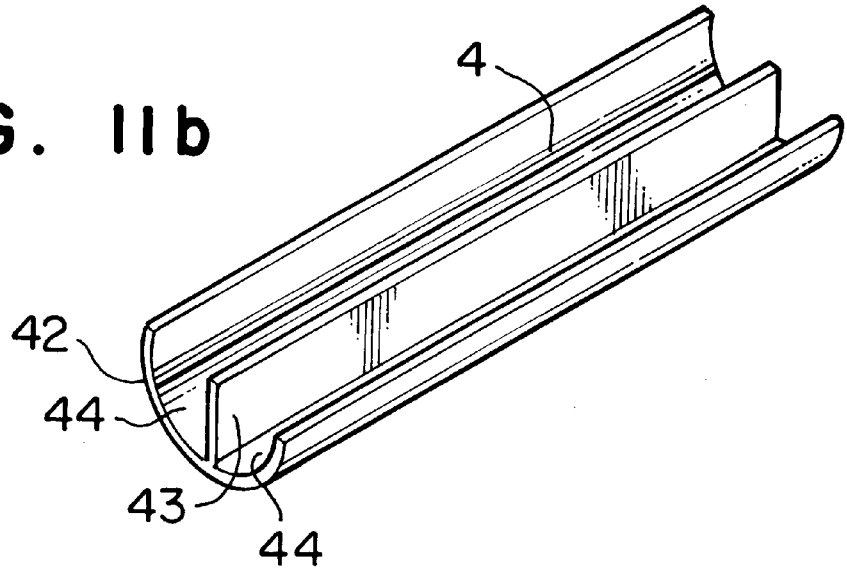
Figure 11C:
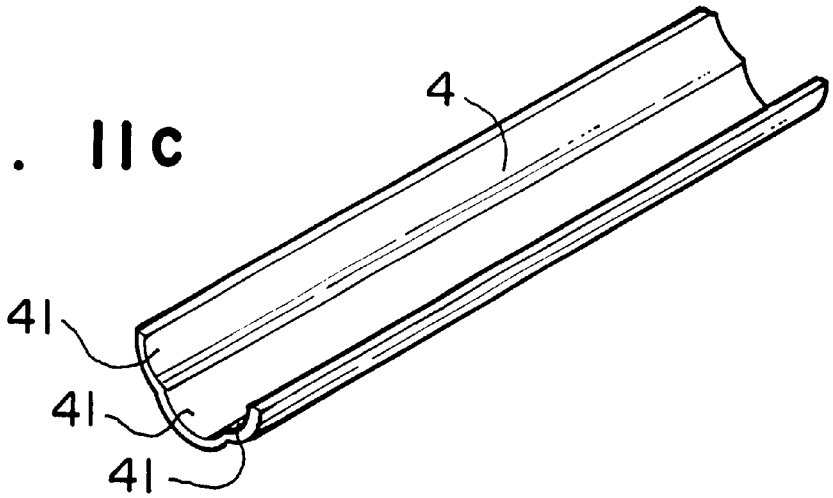

In FIG. 11*a*, two gutters 41 having semi-circular cross-sectional shape and being in parallel each other are connected by, for example, welding side-by-side. FIG. 11*b* shows a partition wall 43 provided longitudinary within the gutter 42 to give two canals 44. FIG. 11*c* shows three gutters 41 are connected side-by-side as same as FIG. 11*a*.

Figure 12:
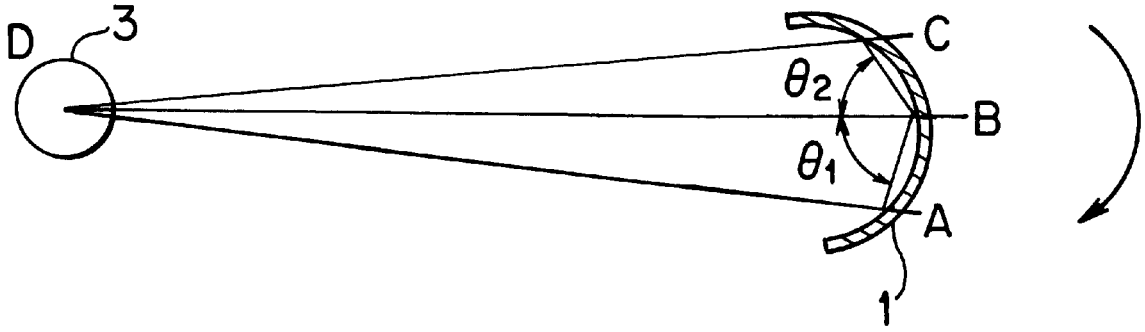
FIG. 12 is a diagram for explaining a declination angle.

In FIGS. 12, A, B and C are three points optionally selected in order from a precedent area towards the following area according to revolution direction, in the horizontal cross-section at the openings of the gutter body or in the rotation plane of the gutter body, and D is the rotation axis on the same cross-section as above. These points A, B, C, and D satisfy the following conditions:

(1) the distance between B and D is greater than or equal to the distance between C and D;

(2) the angle ABD subtended by the line segment AB and the base line BD, and the angle CBD subtended by the line segment BC and the base line BD are named as $\theta_1$ and $\theta_2$, respectively.

A. in the case where the gutter body is revolved in the clockwise direction or to the right direction about the axis D, for $\theta_1$, (+) sign is given, when it is within the preceding area before the base line BD, while (−) sign is given when it is within the following area behind the base line BD; but for $\theta_2$, (−) sign is given, when it is within a following area behind the base line BD while (+) sign is given when it is within a preceding area before the base line BD;

B. in the case where the gutter body is revolved in the counter-clockwise direction or to the left direction, the same signs as in A above are given to $\theta_1$ and $\theta_2$, respectively, i.e., (+) sign is given to $\theta_1$ when $\theta_1$ is within a preceding area before the base line BD.

Preferable range of $\theta_1$ and $\theta_2$ are $$-75° \leqq \theta_1 \leqq 110°$$

$$-75° \leqq \theta_2 \leqq 110°.$$

Moreover, the declination angle is shown as $(\theta_1+\theta_2)/2$. Consequently, the declination angle is zero when the respective absolute angles of $\theta_1$ and $\theta_2$ are equal to each other. This is the same for the connected forms of FIG. 11*a*–FIG. 11*c*.

Figure 13:
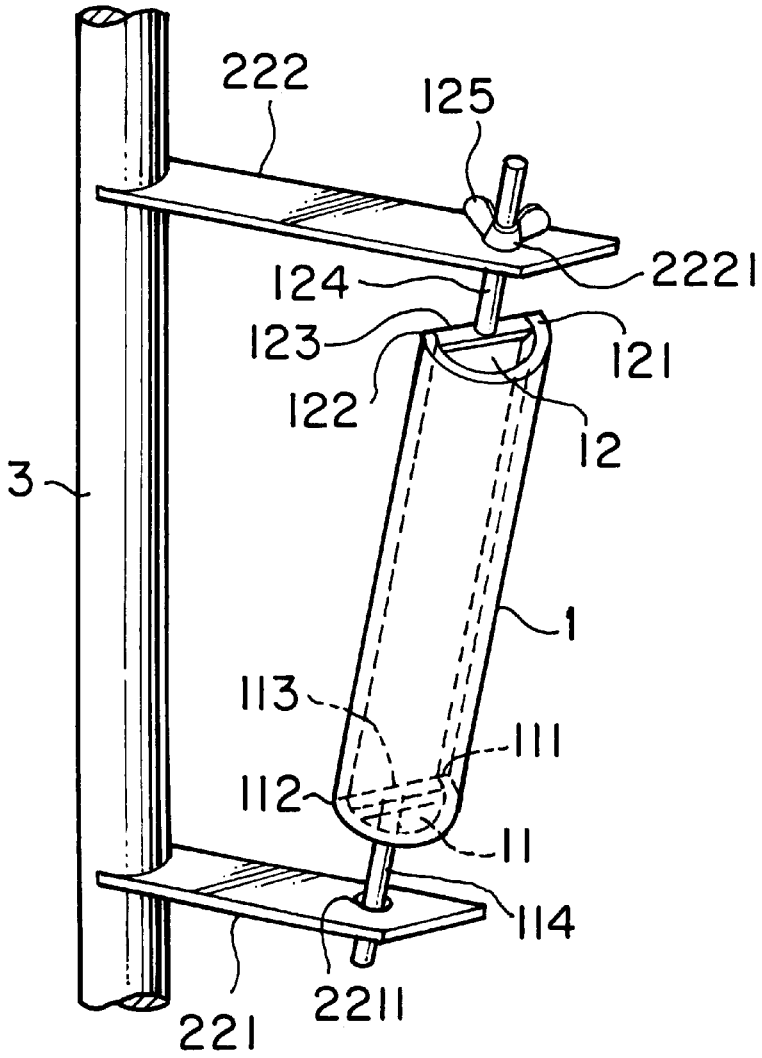
FIG. 13 is a perspective view of a gutter body mounted on an agitator shaft so as to be freely rotatable about itself.

In FIG. 13, a rectangular bar-shaped lower support 113 is provided on a lower opening 11 of the gutter body 1, connecting opening edges 111 and 112 thereof. Moreover, a rectangular bar-shaped upper support 123 is provided on an upper opening 12, connecting opening edges 121 and 122 thereof. Cylindrical rods serving as a lower support rod 114 and an upper support rod 124, are respectively mounted aligned with the longitudinal axis of the gutter body 1, on the centers of the lower support 113 and the upper support 123. A lower attachment device 221 and an upper attachment device 222 are secured radially to the agitator shaft 3. The lower attachment device 221 and the upper attachment device 222 are both slender rectangular shape plates, with the length of the lower attachment device 221 shorter than the length of the upper attachment device 222. The vertical spacing between the lower attachment device 221 and the upper attachment device 222 is made slightly greater than the vertical height of the inclined gutter body 1 (length of gutter body 1×sine of inclination angle). Apertures 2211 and 2221 are respectively drilled in tip portions of the lower attachment device 221 and the upper attachment device 222. The lower support rod 114 and the upper support rod 124 of the gutter body 1 are respectively inserted into the aperture 2211 of the lower attachment device 221 and the aperture 2221 of the upper attachment device 222. A wing nut 125 is threaded onto the upper support rod 124 to contact with the upper face of the upper attachment device 222. With the gutter body 1, when this is turned about the agitator shaft axis, it is automatically turned about the longitudinal axis of the gutter body 1 (about itself) depending on the rotational speed of the agitator shaft 1.

In addition, the gutter body 1 may be turned to a desired deviation angle before being secured. Securing the gutter body 1 is effected by threading a nut not shown onto the upper support rod 124 and clamping the upper attachment device 222 between the nut and the wing nut 125. Alternatively, threading two nuts not shown onto the lower support rod 114 and clamping the lower attachment device 221 between these two nuts. The gutter body 1 may be replaced by the connecting gutter body 4 shown in FIG. 11*a*, FIG. 11*b* and FIG. 11*c*.

With this liquid ejection apparatus of FIG. 14*a*–FIG. 14*d*, the tubular body 5 is used as the slim type liquid-transporting body. Each tubular body 5 has a lower end hinged to the agitator shaft 3 by means of a hinge plate 61, and an upper end connected to a sliding ring 31 by means of a connecting link 62. The hinge plate 61 is attached to the outer peripheral face of the agitator shaft 3. The sliding ring 31 is mounted so as to be slidable on the agitator shaft 3. Furthermore, a wing screw 311 is provided on the sliding ring 31 for securing the sliding ring 31 at an optional position. The connecting link 62 and the sliding ring 31 constitute a vertical traveler device. By moving the sliding ring 31 along the agitator shaft 3 perpendicular to the rotation plane, then the inclination angle of the tubular bodies 5 can be adjusted. Once the inclination angle of the tubular bodies 5 is at a predetermined size, the sliding ring 31 is secured to the agitator shaft 3 by means of the wing screw 311.

Figure 14A:
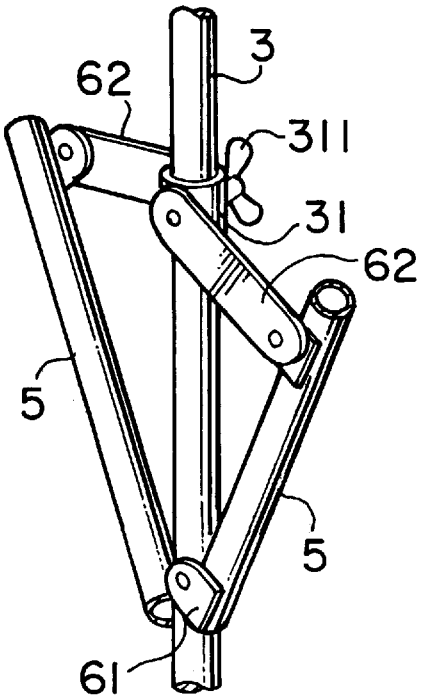
FIG. 14*a*–FIG. 14*d* show a perspective view, a plane view, a front view and a side view, respectively, of a tube body attachment part where the size of an inclination angle of a tube body slim type liquid-transporting body is adjustable by means of a vertical system.
Figure 14B:
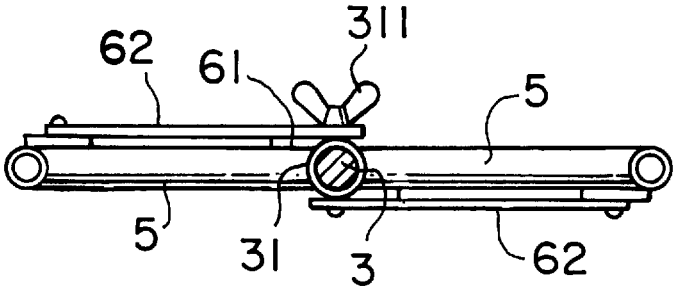
Figure 14C:
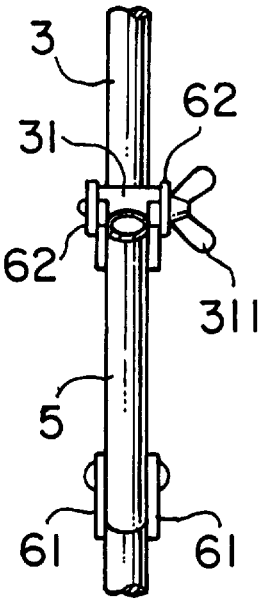
Figure 14D:
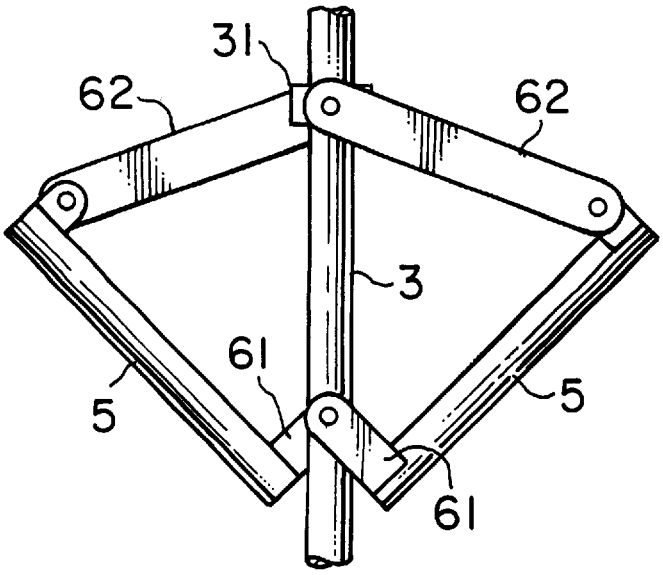
Figure 15A:
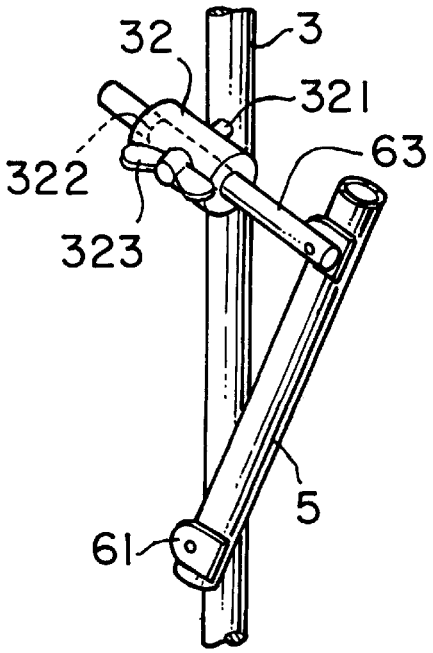
FIG. 15*a*–FIG. 15*d* show a perspective view, a plane view, a front view and a side view, respectively, of a tube body attachment part where the size of an inclination angle of a tube body slim type liquid-transporting body is adjustable by means of a horizontal system.
Figure 15B:
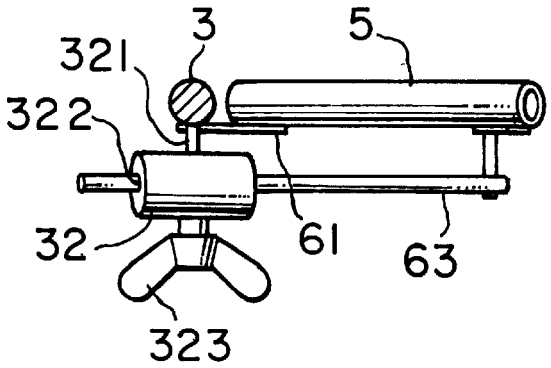
Figure 15C:
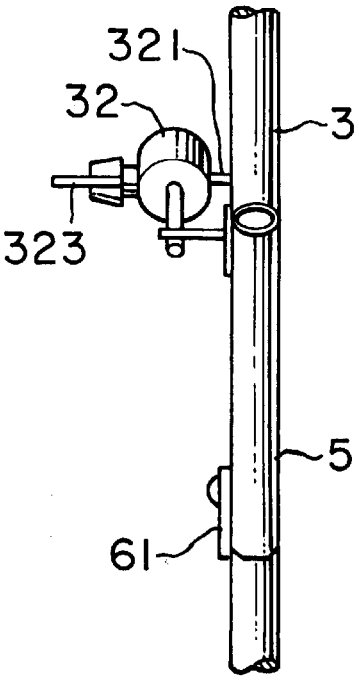
Figure 15D:
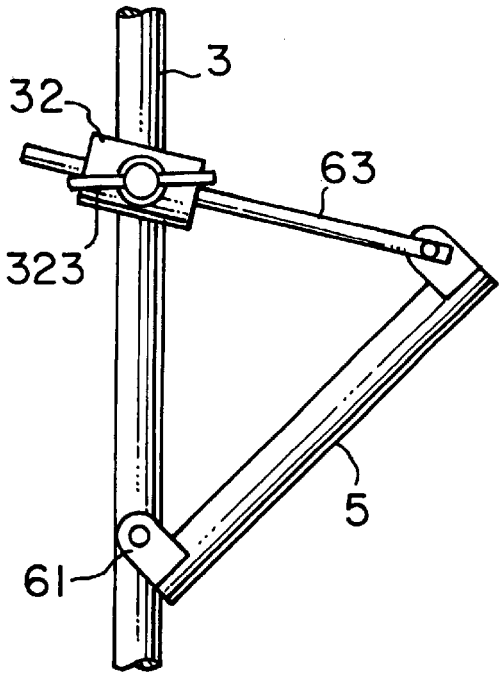

The liquid ejection apparatus where the tubular bodies 5 for which the inclination angle can be adjusted by the vertical system shown in FIG. 14*a* are slim type liquid-transporting bodies, is arranged inside a tank or inside a flask. In the case where the tubular bodies 5 (slim type liquid-transporting bodies) are inclined to a desired inclination angle and secured inside the tank or flask, a stopper not shown can be provided on the agitator shaft 3, and by abutting the sliding ring 31 against the stopper, then the tubular bodies 5 (slim type liquid-transporting bodies) can be inclined to a desired inclination angle. Consequently, by changing the location of the stopper, then the inclination angle can be adjusted. In this case, the wing screw 311 can of course be omitted. Moreover, in the case where the tubular bodies 5 (slim type liquid-transporting bodies) are inclined by slidingly contacting the upper end of the tubular bodies 5 (slim type liquid-transporting bodies) against the inner peripheral face of the tank or the inner peripheral face of the flask, then it is not necessary to provide the stopper on the agitator shaft 3. Furthermore, it is not necessary to provide both the sliding ring 31 and the connecting link 62. In this case, the length of the tubular bodies 5 (slim type liquid-transporting bodies) must be longer than the radius of the tank or the radius of the flask at the lower end of the tubular bodies 5. Moreover, by changing the length of the tubular bodies 5, then the inclination angle can be adjusted.

In FIG. 15*a*–FIG. 15*d*, the tubular body 5 is used as the slim type liquid-transporting body. The tubular body 5 has a lower end hinged to the agitator shaft 3 by means of a hinge plate 61, and an upper end connected to a pivot collar 32 by means of a connecting rod 63. The hinge plate 61 is secured to the outer peripheral face of the agitator shaft 3. The pivot collar 32 is supported on a pivot shaft 321 so as to revolve in a plane parallel with the longitudinal axis of the agitator shaft 3. Furthermore a bore 322 is drilled in the center of the pivot collar 32 along the longitudinal axis thereof. A wing screw 323 for securing the connecting rod 63 is provided on the pivot collar 32 so as to reach into the bore 322. The connecting rod 63 is inserted into the bore 322 of the pivot collar 32. The connecting rod 63 and the pivot collar 32 constitute a horizontal traveler device. By moving the connecting rod 63 which is inserted into the bore 322 of the pivot collar 32 back and forth inside the bore 322, then the inclination angle of the tubular body 5 can be adjusted. Once the inclination angle of the tubular body 5 is at a predetermined size, the connecting rod 63 is secured to the agitator shaft 3 via the pivot collar 32 by means of the wing screw 323.

With the liquid ejection apparatus where the tubular body 5 for which the size of the inclination angle can be adjusted by the horizontal system shown above is a slim type liquid-transporting body, by providing a stopper not shown, instead of the wing screw 323, on the free end side of the rod 63 (the end which is not connected to the tubular body 5), then the tubular body 5 (slim type liquid-transporting body) can be inclined to a desired inclination angle. In this case, by changing the location of the stopper, then the inclination angle can be adjusted.

Moreover, with this liquid-ejection apparatus, the tubular body 5 (slim type liquid-transporting body) can be inclined to a desired inclination angle by slidingly contacting the upper end thereof against the inner peripheral face of the tank. In this case, the length of the tubular body 5 (slim type liquid-transporting body) must be longer than the radius of the tank at the lower end of the tubular body 5. Moreover, by changing the length of the tubular body 5 (slim type liquid-transporting body), then the inclination angle can be adjusted. Furthermore, in this case, the pivot collar 32, the wing screw 323 and the connecting rod 63 are not required.

Figure 16A:
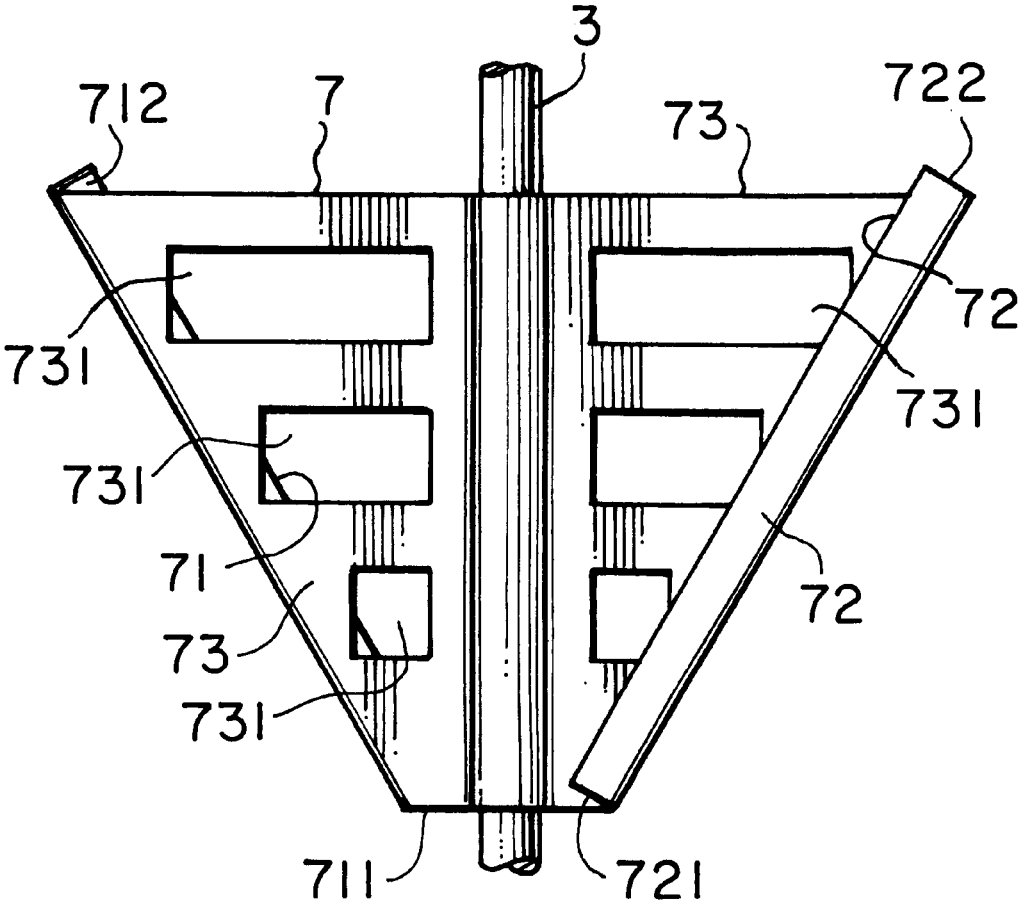
FIG. 16*a* and FIG. 16*b* show a front view and a plane view, respectively, of two integrally formed opposite gutter bodies in a liquid-ejection apparatus of the invention.
Figure 16B:
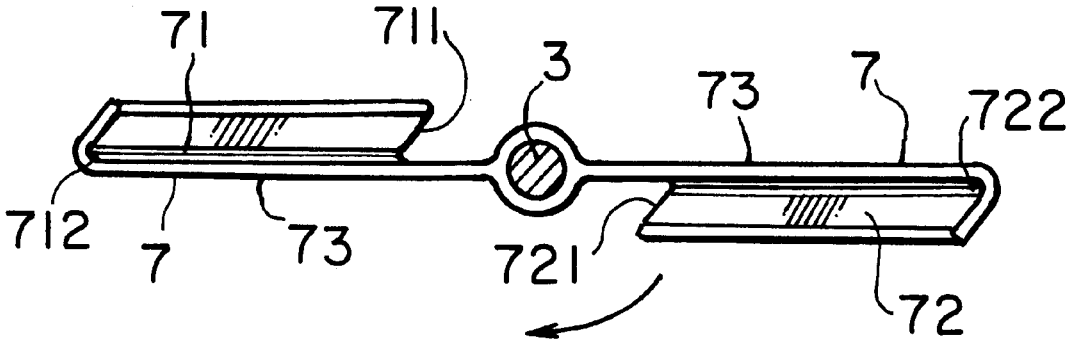

In FIG. 16*a* and FIG. 16*b*, an inverted trapezoid shape plate 7 is attached to the agitator shaft 3, with opposite inclined side portions thereof bend in opposite directions to each other in the revolution plane to thereby form two opposed gutter bodies 71, 72. The respective shapes of the lower openings 711, 721 and the upper openings 712, 722 of the gutter bodies 71, 72 are both non-symmetrical V-shapes with one side longer and with rounded vertices. Moreover, unbent flat portions 73 of the inverted trapezoid shape plate 7 constitute an attachment device, which in addition acts as an agitator blade. Six rectangular openings 731 are formed transversely in the flat portions 73 to reduce fluid resistance. The gutter bodies 71, 72 are revolved so that the short side of the non-symmetrical V-shape leads (clockwise in the figure).

Figure 17A:
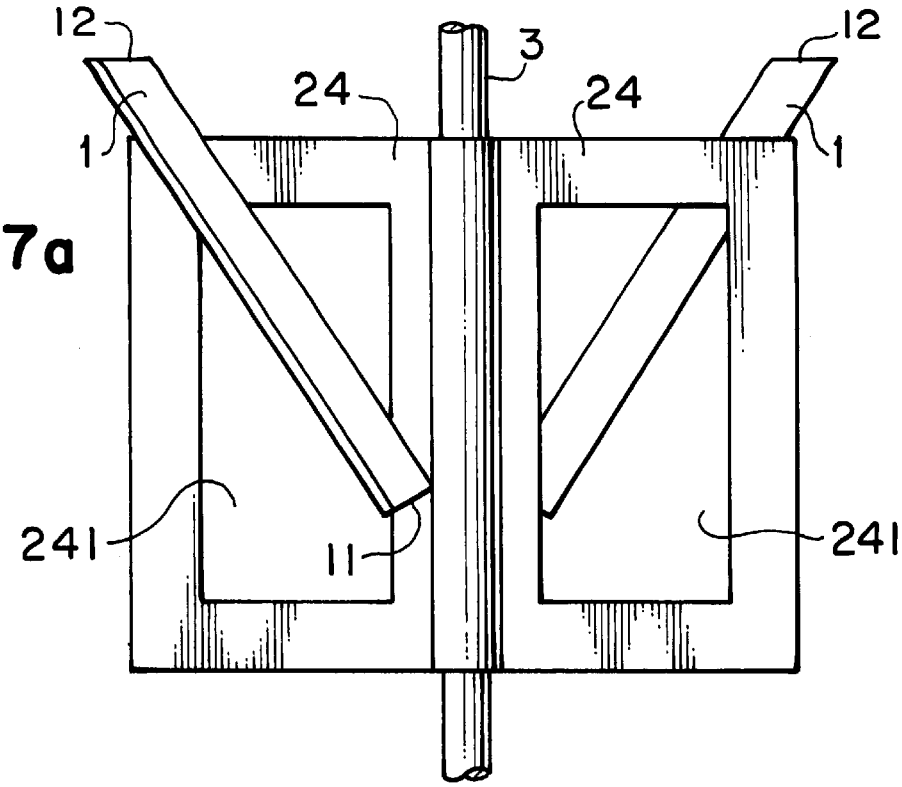
FIG. 17*a* and FIG. 17*b* show a front view and a plane view, respectively, of gutter bodies attached eccentrically in a liquid-ejection apparatus of the invention.
Figure 17B:
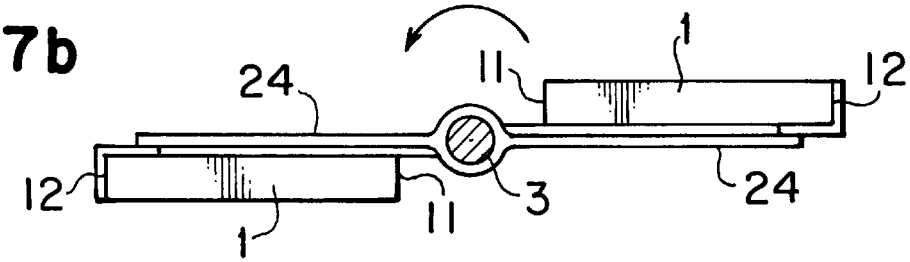

In FIG. 17*a* and FIG. 17*b*, attachment devices 24 in the form of a plates with rectangular apertures 241 formed in narrow rectangular shapes in central portions, are secured to the agitator shaft 3 on the same diameter passing through the center of the agitator shaft 3. Equal sided V-shaped members serving as gutter bodies 1 are attached to the attachment devices 24 with one face secured thereto. The deviation angle is 45°. The gutter bodies 1 are attached to the attachment devices 24 at an incline with their lower openings 11 closer to the agitator shaft 3 than their upper openings 12. The faces on the attachment devices 24 for attaching the gutter bodies 1 are opposite faces to each other. These gutter bodies are turned in the counter-clockwise direction viewed from above in the figure.

Figure 17C:
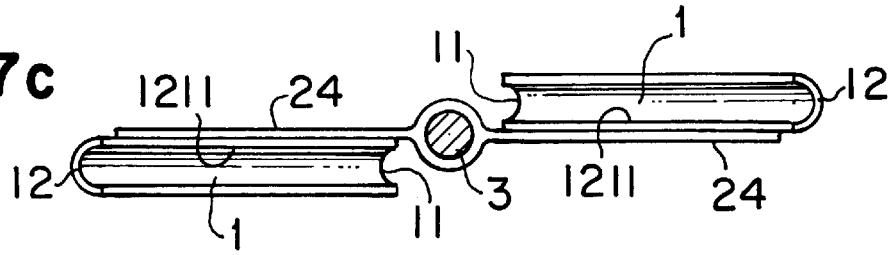
FIG. 17*c* and FIG. 17*d* show front views of modified gutter bodies based on FIG. 17*a* and FIG. 17*b;*
Figure 17D:
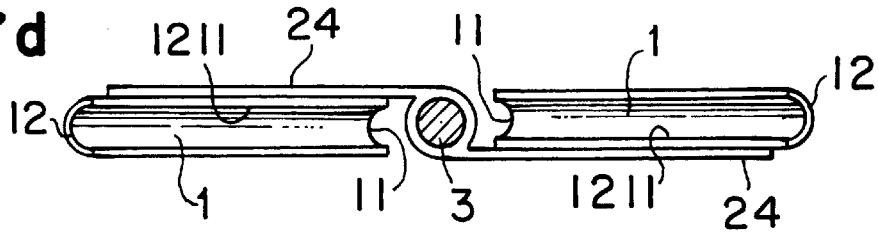

In FIG. 17*c*, an elongated bottomless haft cut circular tube serves as the gutter body 1. Apart from being attached at the upper face opening edge rim 1211 so as to be tangent to the attachment device 24, there is substantially no difference to the gutter body in the liquid ejection apparatus of the invention shown in FIG. 17*a* and FIG. 17*b*. With the gutter bodies 1 shown in FIG. 17*a*. FIG. 17*b* and FIG. 17*c*, their respective longitudinal axes directions do not coincide with the diameter in the rotation plane, but are eccentric thereto. In FIG. 17*d*, the attachment device 24 is attached tangential to the outer peripheral face of the agitator shaft 3 50 that the respective longitudinal axis directions of the gutter bodies 1 coincide with the diameter in the rotation plane, and are not eccentric. Apart from this, there is substantially no difference to the gutter bodies in the liquid ejection apparatus of the present invention shown in FIG. 17*c*. FIG. 17*d* mode is the most preferable, because large liquid volume is ejected from the upper opening 12.

Figure 18A:
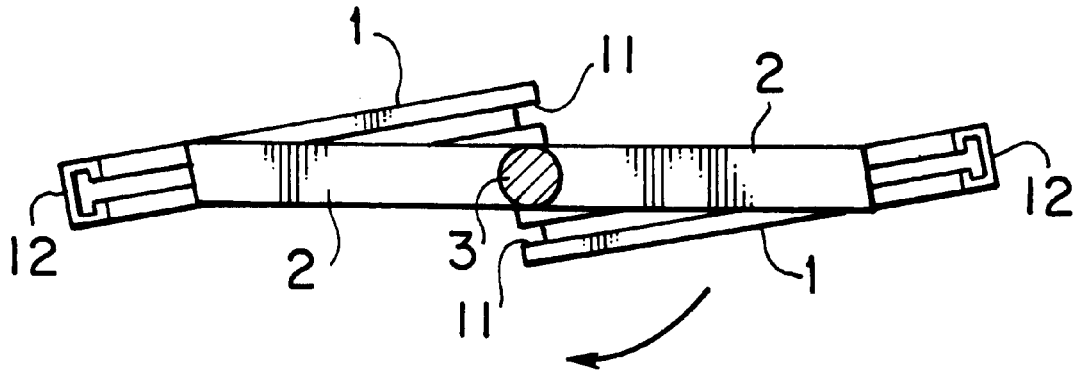
FIG. 18*a* and FIG. 18*b* show a plane view and a front view, respectively, of gutter bodies attached eccentrically in a liquid ejection apparatus of the invention.
Figure 18B:
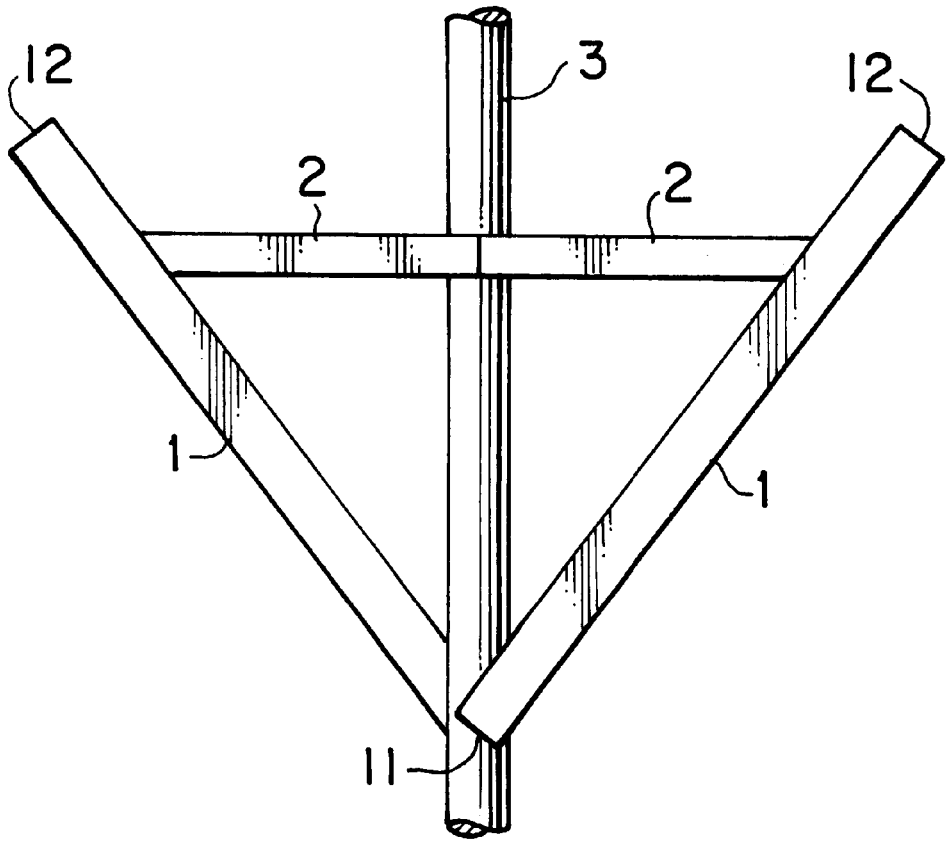

In FIG. 18*a* and FIG. 18*b*, elongate rectangular plate attachment device 2 are located on the radius of the revolution plane and are secured to the agitator shaft 3. The length of the attachment devices 2 are substantially the same as each other. The gutter bodies 1 are made of two C-shaped bars having rectangular shape in cross-section. The top face openings are faced inwards, with respective upper portions secured to the tip ends of the attachment devices 2, and lower portions secured tangentially to the peripheral surface of the agitator shaft 3, so that lower openings 11 are closer to the agitator shaft 3 than upper openings 12, thereby inclining the gutter bodies 1 with respect to the agitator shaft 3. The lower portions of the gutter bodies 1 are secured to the peripheral surfaces on opposite sides of the agitator shaft 3. As a result the respective longitudinal axes of the gutter bodies 1 are eccentric. Furthermore, the gutter bodies 1 are preferably turned with the lower openings 11 leading and the upper openings 12 following (clockwise in the figure).

Figure 19A:
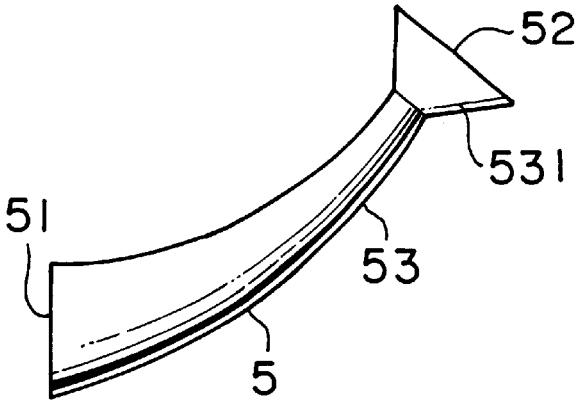
FIG. 19*a* and FIG. 19*b* show a side view and a perspective view, respectively, of a shower type tubular body slim type liquid-transporting body.
Figure 19B:
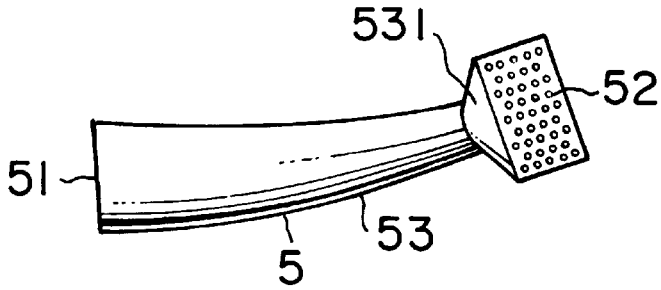

In FIG. 19*a* and FIG. 19*b*, the tube portion 53 of the tubular body 5 is bent upward at a small curvature as viewed from the side, and the central portion is protruded downwards. Also, as viewed from above, this is bent at a slight curvature. Moreover, the upper end of the tube portion 53 has a funnel-shaped funnel portion 531. The tip of funnel portion 531 is the upper opening 52. The shape of a lower opening 51 is circular and the upper opening 52 is covered with a rectangular perforated plate. Additionally, the respective opening directions of the lower opening 51 and the upper opening 52 are horizontal and inclined upward.

Figure 20A:
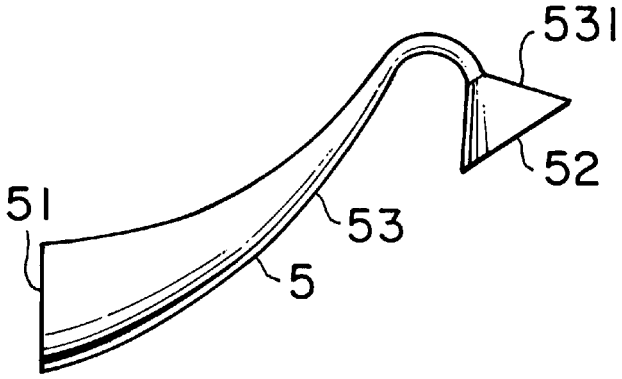
FIG. 20*a* and FIG. 20*b* show a side view and a perspective view, respectively, of a spray shower type tubular body slim type liquid-transporting body.
Figure 20B:
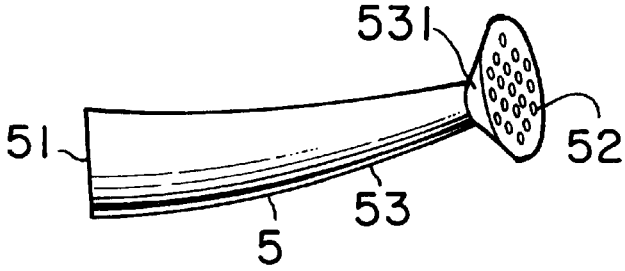

In FIG. 20*a* and FIG. 20*b*, the tube portion 53 of the tubular body 5 is a lengthwise S-shape as viewed from the side, with an upper end bent downward at an incline. Also, as viewed from beneath, this is bent at a slight curvature. The upper end of the tube portion 53 has a funnel-shaped funnel portion 531 and the tip thereof is an upper opening 52. The shape of a lower opening 51 is circular, and the upper opening 52 is covered with an oval shaped perforated plate. Additionally, the respective opening directions of the lower opening 51 and the upper opening 52 are horizontal and inclined downward.

Figure 21A:
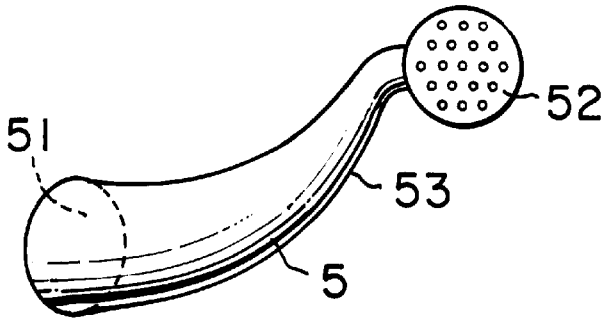
FIG. 21*a* and FIG. 21*b* show a perspective view and a side view, respectively, of a spray shower type tubular body slim type liquid-transporting body.
Figure 21B:
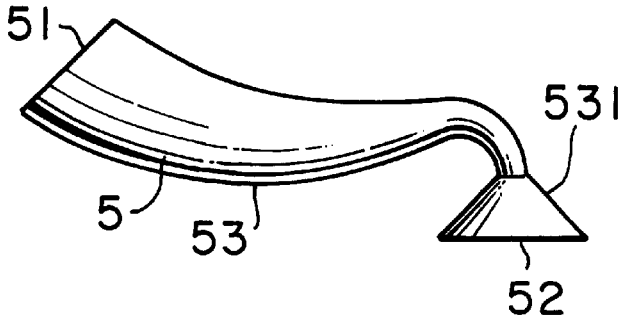

In FIG. 21*a* and FIG. 21*b*, the tube portion 53 of the tubular body 5 is a lengthwise S-shape as viewed from the side, and the lower portion as viewed from beneath, is bent at a slight curvature towards the agitator shaft 3. The upper end of the tube portion 53 has a funnel-shaped funnel portion 531 and the tip thereof is an upper opening 52. The shape of a lower opening 51 is circular, and the upper opening 52 is covered with an oval shaped perforated plate. Additionally, the respective opening directions of the lower opening 51 and the upper opening 52 are horizontal and inclined downward.

Figure 22A:
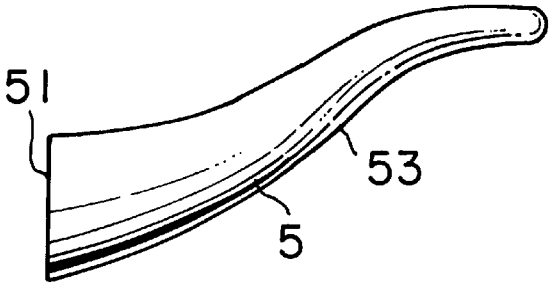
FIG. 22*a* and FIG. 22*b* show a side view and a perspective view, respectively of a spray type tubular body (blind) slim type liquid-transporting body.
Figure 22B:
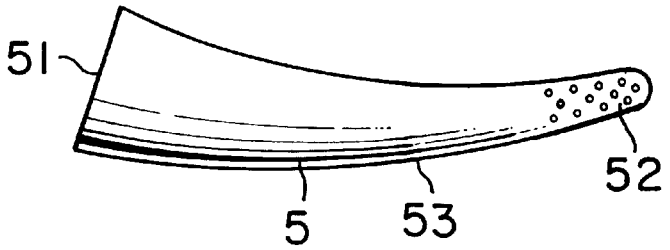

In FIG. 22*a* and FIG. 22*b*, the tube portion 53 of the tubular body 5 is a flattened S-shape as viewed from the side, and the lower portion as viewed from beneath, is bent at a slight curvature. The direction of this curvature is such that when the tubular body 5 is attached to the attachment device, a lower opening 51 is directed so as to approach the agitator shaft 3. Moreover, the upper end of the tube portion 53 is closed off (blind). A plurality of holes are pierced as an upper end opening 52, in a lower face of the upper end of the tube portion 53. The shape of the lower opening 51 is circular. Furthermore, the respective opening directions of the lower opening 51 and the upper opening 52 are horizontal and downward.

Figure 23A:
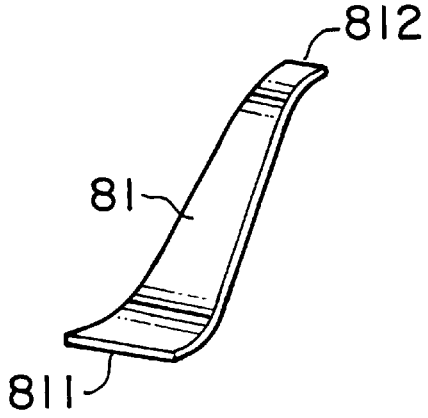
FIG. 23*a*–FIG. 23*c* show a perspective view, a side view and a front view, respectively, of a plate type tubular body slim type liquid-transporting body.
Figure 23B:
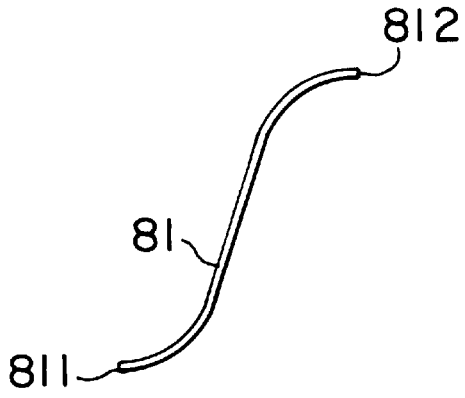
Figure 23C:
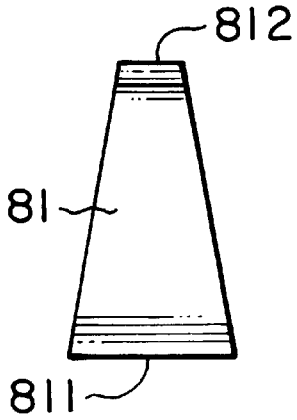

In FIG. 23*a*–FIG. 23*c*, the plate body 81 (slim type liquid-transporting body) shown has the overall side face view as an elongate S-shape, and the overall shape of the top face view as an elongate trapezoid. Furthermore, with the plate body 81, the lower edge and the upper edge thereof respectively constitute a lower opening 811 and an upper opening 812.

Figure 24A:
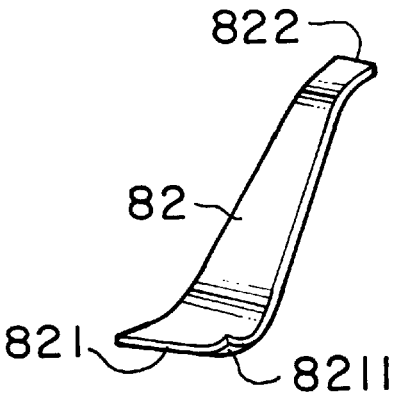
FIG. 24*a* and FIG. 24*b* show a perspective view and a front view, respectively, of another aspect of a plate type tubular body slim type liquid-transporting body.
Figure 24B:
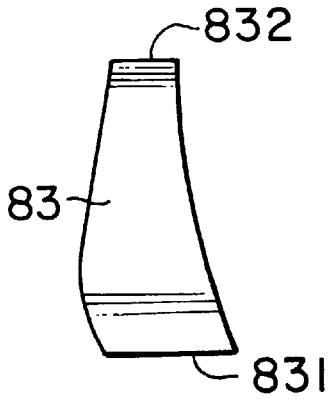

In FIG. 24*a* and FIG. 24*b*, a plate body 82 has an elongate trapezoid plate with a lower edge outer peripheral portion 8211 thereof (the following portion when turned to the right) twisted upward. With the plate body 82, the lower edge and upper edge of the plate body 82 respectively constitute a lower opening 821 and an upper opening 822. With the plate body 83, the lower edge and upper edge of the plate body 83 respectively constitute the lower opening 831 and an upper opening 832.

With the plate bodies (slim type liquid-transporting bodies) shown respectively in FIG. 23*a*–FIG. 24*b*, the opening area of the lower opening is the length of the straight line or curved line of the lower edge, and that of the upper end opening is the length of the straight line of the upper edge. The opening area of the lower opening is made greater than that of the upper opening.

Figure 25A:
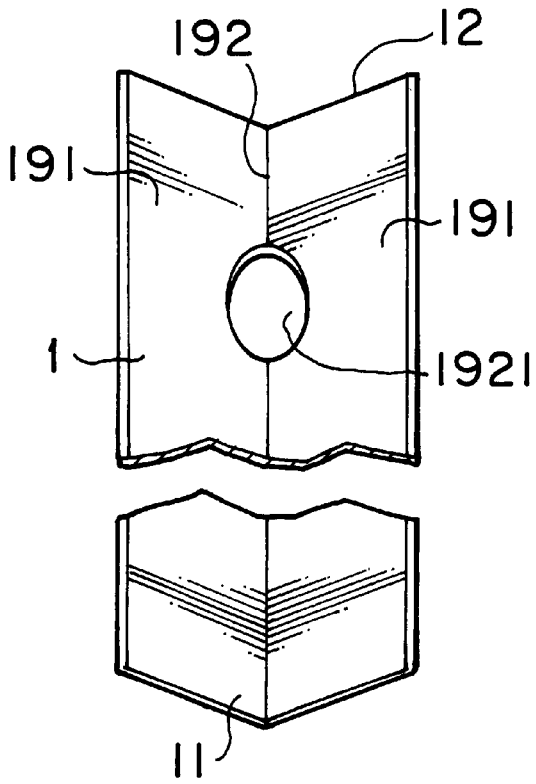
FIG. 25*a* dnd FIG. 25*b* show a front view and a side view, respectively, of a gutter body with a through hole pierced in a wall.
Figure 25B:
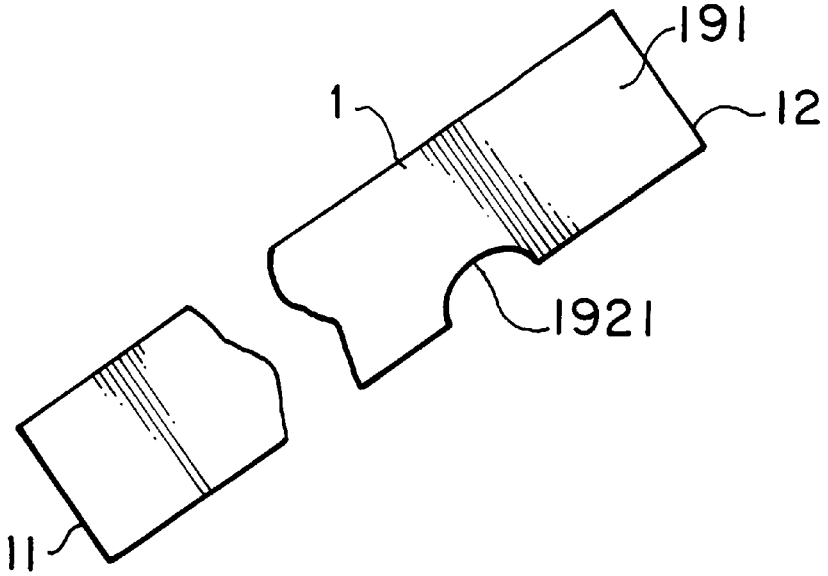

In FIG. 25*a* and FIG. 25*b*, an equal sided V-shaped member constitutes the gutter body 1, with a ridge line 192, being the connecting portion of the two faces 191, serving as the liquid flow path. An aperture 1921 is pierced in the ridge line 192. With the liquid flowing upward along the path of the gutter body 1, a part thereof is ejected from the aperture 1921, while the remainder is ejected from an upper opening 12.

Figure 26:
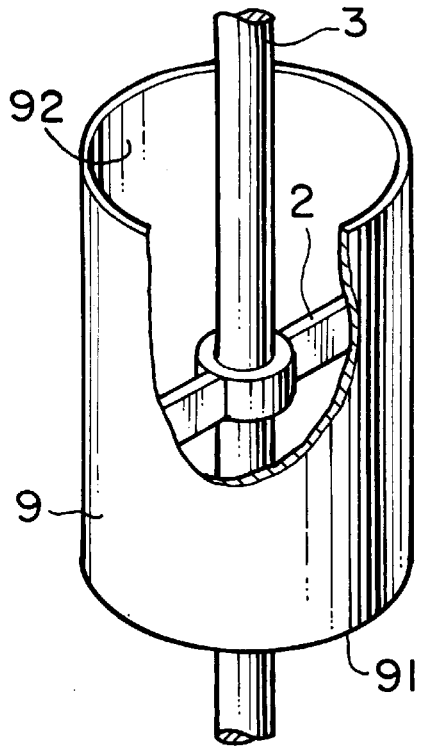
FIG. 26 is a partially cut away perspective view of a stout type liquid-transporting body.

In FIG. 26, a bottomless open circular tube is a circular tube type liquid transporting body 9 (stout type liquid transporting body). This circular tube type liquid-transporting body 9 is attached to an attachment device 2 which is secured to the peripheral wall on the diameter thereof, and the center of the attachment device 2 is secured to the agitator shaft 3. With the circular tube type liquid-transporting body 9, a lower end and an upper end respectively constitute a lower opening 91 and an upper opening 92. Moreover, the angle between the peripheral wall of the circular tube type liquid-transporting body 9 and the revolution plane is the inclination angle, being 90°. By rotating the agitator shaft 3, then the liquid at the liquid immersed portion of the circular tube type liquid-transporting body 9 is raised at an incline up the inner face of the peripheral wall, and then ejected from the upper opening 92.

Figure 27:
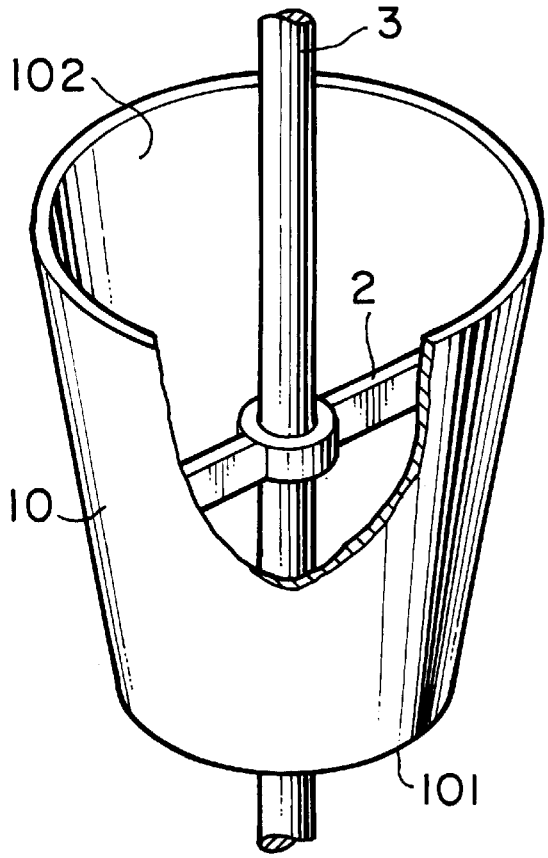
FIG. 27 is a partially cut away perspective view of another stout type liquid-transporting body.

In FIG. 27, a bottomless open circular tube is an inverted truncated cone type liquid transporting body 10. This inverted truncated cone type liquid transporting body 10 is attached to an attachment device 2 which is secured to the peripheral wall on the diameter thereof, and the center of the attachment device 2 is secured to the agitator shaft 3. With the inverted truncated cone type liquid transporting body 10, a lower end and an upper end respectively constitute a lower opening 101 and an upper opening 102. By rotating the agitator shaft 3, then the liquid at the liquid immersed portion of the inverted truncated cone type liquid transporting body 10 is raised at an incline up the inner face of the peripheral wall, and then ejected from the upper opening 102. With the inverted truncated cone type liquid transporting body 10 shown in FIG. 27, apart from being a bottomless inverted truncated cone open tubular body instead of a bottomless open circular tube, there is substantially no difference to the circular tube type liquid-transporting body 9 shown in FIG. 26.

With the liquid-ejection apparatus of the present invention, the construction is simple, and, by merely rotating the agitator shaft, the slim type liquid-transporting body or the stout type liquid-transporting body is revolved about the agitator shaft, until a large volume of the liquid can be ejected over a large ejection distance. Moreover by changing the rotation speed of the agitator shaft corresponding to the liquid depth, long ejection distance and an enough amount of the ejection liquid above can be maintained. By means of this ejected liquid, washing of an inner peripheral surface of a tank, maintenance of a heat transfer area and washing of a heat transfer surface are simplified.

Furthermore, fermentation tanks, reaction tanks, mixing tanks, evaporation tanks, crystallization tanks or extraction tanks wherein the present apparatus is provided can be operated with ease, no matter what varieties and how much may be, so far as liquid to be treated is concerned. Energy required can be greatly saved. Smaller apparatus are enough, because capacity becomes larger. Construction is so simple that scale-up can easily be made.

What is claimed is:

1. A method for distributing liquid comprising:

revolving a liquid-transporting body in liquid in a tank around a vertical rotation shaft mounted in the tank; and controlling rotation speed of a motor rotating said rotation shaft depending on liquid depth in the tank so that the torque of said rotation shaft is maintained at a substantially constant level, said liquid-transporting body being supported longitudinally by the shaft so that a distance from the shaft to the top of the transporting body is equal to or greater than a distance from the shaft to the bottom of the transporting body, the top of the transporting body being exposed above the liquid in the tank while the bottom thereof being kept in the liquid in the tank, until liquid in the tank is scooped up in the liquid-transporting body and is ejected from the top of the transporting body.

2. A method according to claim 1, wherein liquid is contacted against a heat transfer device to alter the temperature of said liquid.

3. The method according to claim 2, wherein a detected liquid depth is transmitted to a rotational speed change device connected to said motor, so that rotation speed of said rotation shaft is controlled depending on said liquid depth.

4. A method according to claim 1, wherein said liquid-transporting body is a tubular body.

5. The method according to claim 4, wherein a detected liquid depth is transmitted to a rotational speed change device connected to said motor, so that rotation speed of said rotation shaft is controlled depending on said liquid depth.

6. A method according to claim 1, wherein said liquid-transporting body is an open pipe-shaped gutter body.

7. The method according to claim 6, wherein a detected liquid depth is transmitted to a rotational speed change device connected to said motor, so that rotation speed of said rotation shaft is controlled depending on said liquid depth.

8. The method according to claim 1, wherein a detected liquid depth is transmitted to a rotational speed change device connected to said motor, so that rotation speed of said rotation shaft is controlled depending on said liquid depth.

9. A method according to claim 1, wherein the liquid-transporting body is movable to incline within the range of 5 to 85° against the rotation shaft.

10. A method according to claim 9, wherein, when the liquid-transporting body is an open pipe-shaped gutter, the inner surface thereof faces towards the rotation shaft, and wherein A, B, and C are points on said gutter with B being between A and C, D is a rotation axis of said rotation shaft. BD is a base line, angle $\theta_1$ is the angle between line segments AB and BD, angle $\theta_2$ is the angle between lines BC and BD, and $\theta_1$ and $\theta_2$ are respectively selected within the range of −75° to 110°.

11. A method according to claim 1, wherein, when the liquid-transporting body is an open pipe-shaped gutter, the body has two or more canals connected in parallel.

12. A method according to claim 1, wherein, when the liquid-transporting body is a frame-worked body, an edge which faces a wall of the tank is bent to form an open pipe-shaped gutter.

13. A method according to claim 1, wherein, when the liquid-transporting body is a frame-worked body, an open pipe-shaped gutter is fixed in an inclined direction on the transporting body.

14. A method for distributing liquid comprising:

revolving a liquid-transporting body in liquid in a tank around a vertical rotation shaft mounted in the tank; and controlling rotation speed of said rotation shaft depending on liquid depth in the tank so that the speed of said rotation shaft is increased as the liquid depth in the tank decreases, said liquid-transporting body being supported longitudinally by the shaft so that a distance from the shaft to the top of the transporting body is equal to or greater than a distance from the shaft to the bottom of the transporting body, the top of the transporting body being exposed above the liquid in the tank while the bottom thereof being kept in the liquid in the tank, until liquid in the tank is scooped up in the liquid-transporting body and is ejected from the top of the transporting body.

* * * * *